US011408627B2

(12) United States Patent
Takata et al.

(10) Patent No.: US 11,408,627 B2
(45) Date of Patent: Aug. 9, 2022

(54) AIR-CONDITIONING APPARATUS

(71) Applicant: Mitsubishi Electric Corporation, Tokyo (JP)

(72) Inventors: Shigeo Takata, Tokyo (JP); Takuya Kontani, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 7 days.

(21) Appl. No.: 16/967,820

(22) PCT Filed: Mar. 2, 2018

(86) PCT No.: PCT/JP2018/008000
§ 371 (c)(1),
(2) Date: Aug. 6, 2020

(87) PCT Pub. No.: WO2019/167249
PCT Pub. Date: Sep. 6, 2019

(65) Prior Publication Data
US 2020/0393155 A1 Dec. 17, 2020

(51) Int. Cl.
*F24F 11/46* (2018.01)
*F24F 11/49* (2018.01)
(Continued)

(52) U.S. Cl.
CPC ..... *F24F 11/46* (2018.01); *F24F 11/49* (2018.01); *F24F 11/84* (2018.01); *F24F 2110/10* (2018.01); *F24F 2140/20* (2018.01)

(58) Field of Classification Search
CPC .. F24F 11/84; F24F 11/46; F24F 11/49; F24F 2110/10; F24F 2140/20
See application file for complete search history.

(56) References Cited

U.S. PATENT DOCUMENTS 5,123,255 A * 6/1992 Ohizumi ..... G05D 23/1934 62/175
6,298,677 B1 * 10/2001 Bujak, Jr. ..... F24F 3/06 62/158
(Continued)

FOREIGN PATENT DOCUMENTS

JP S47-35143 U 12/1972
JP H06-323605 A 11/1994
(Continued)

OTHER PUBLICATIONS

Machine translation of JP2002-31371 (Jan. 31, 2002). (Year: 2002).*
(Continued)

*Primary Examiner* — Marc E Norman
(74) *Attorney, Agent, or Firm* — Posz Law Group, PLC

(57) ABSTRACT

An air-conditioning apparatus includes a plurality of indoor units. Each of the indoor units includes a heat-medium flow adjusting valve and a heat exchanger. The heat-medium flow adjusting valve adjusts the flow rate of a heat medium that flows into the heat-medium flow adjusting valve, and causes the heat medium to flow out of the heat-medium flow adjusting valve. The heat exchanger causes heat exchange to be performed between the heat medium and air. The heat medium flows into the heat exchanger from an inflow side of the heat exchanger. The inflow side of the heat exchanger is connected to an outflow side of the heat-medium flow adjusting valve. The plurality of indoor units are connected in series.

3 Claims, 15 Drawing Sheets

(51) Int. Cl.

| | |
|---|---|
| ***F24F 11/84*** | (2018.01) |
| *F24F 110/10* | (2018.01) |
| *F24F 140/20* | (2018.01) |

(56) References Cited

U.S. PATENT DOCUMENTS

| | | | | |
|---|---|---|---|---|
| 7,219,506 | B2 * | 5/2007 | Kang | F24F 11/83 62/176.6 |
| 9,322,562 | B2 * | 4/2016 | Takayama | F24F 3/065 |
| 10,161,665 | B2 * | 12/2018 | Wu | F25D 11/022 |
| 2015/0292757 | A1 | 10/2015 | Motomura et al. | |
| 2021/0048216 | A1 * | 2/2021 | Takata | F25B 13/00 |

FOREIGN PATENT DOCUMENTS

| | | | | |
|---|---|---|---|---|
| JP | H10-281474 | A | | 10/1998 |
| JP | 2002-31371 | A | * | 1/2002 |
| JP | 2004-085141 | A | | 3/2004 |
| JP | 2012-042105 | A | | 3/2012 |
| JP | 2015-004482 | A | | 1/2015 |
| JP | 2015-206519 | A | | 11/2015 |
| JP | 2016-211825 | A | | 12/2016 |
| JP | 2017-009269 | A | | 1/2017 |
| WO | 2014/083652 | A1 | | 6/2014 |

OTHER PUBLICATIONS

International Search Report of the International Searching Authority dated Apr. 24, 2018 for the corresponding International application No. PCT/JP2018/008000 (and English translation).

* cited by examiner

FIG. 12

| FCU NUMBER | FCU PERFORMANCE | OPENING DEGREE OF THREE-WAY VALVE | |
|---|---|---|---|
| | | FCU OPENING DEGREE | BYPASS OPENING DEGREE |
| 21a | 1kW | 20% | 80% |
| 21b | 1kW | 20% | 80% |
| 21c | 5kW | 100% | 0% |

FIG. 13

| FCU NUMBER | FCU PERFORMANCE | OPENING DEGREE OF THREE-WAY VALVE | | |
|---|---|---|---|---|
| | | FCU OPENING DEGREE | BYPASS OPENING DEGREE | |
| 21a | 1kW | 20% | 80% | |
| 21b | 1kW | 0% | 100% | ← THERMO-OFF STATE |
| 21c | 5kW | 100% | 0% | |

FIG. 14

| FCU NUMBER | FCU PERFORMANCE | OPENING DEGREE OF THREE-WAY VALVE | |
|---|---|---|---|
| | | FCU OPENING DEGREE | BYPASS OPENING DEGREE |
| 21a | 1kW | 33% | 67% |
| 21b | 1kW | 33% | 67% |
| 21c | 3kW | 100% | 0% |

FIG. 17

| SYSTEM #1 | | | | SYSTEM #2 | | | | SYSTEM #3 | | | |
|---|---|---|---|---|---|---|---|---|---|---|---|
| FCU NUMBER | FCU PERFORMANCE | OPENING DEGREE OF THREE-WAY VALVE | | FCU NUMBER | FCU PERFORMANCE | OPENING DEGREE OF THREE-WAY VALVE | | FCU NUMBER | FCU PERFORMANCE | OPENING DEGREE OF THREE-WAY VALVE | |
| | | FCU OPENING DEGREE | BYPASS OPENING DEGREE | | | FCU OPENING DEGREE | BYPASS OPENING DEGREE | | | FCU OPENING DEGREE | BYPASS OPENING DEGREE |
| 21a | 1kW | 20% | 80% | 21d | 3kW | 43% | 57% | 21g | 4kW | 100% | 0% |
| 21b | 2kW | 40% | 60% | 21e | 7kW | 100% | 0% | 21h | 1kW | 25% | 75% |
| 21c | 5kW | 100% | 0% | 21f | 1kW | 14% | 86% | 21i | 2kW | 50% | 50% |

FIG. 18

| SYSTEM #1 | | | | SYSTEM #2 | | | | SYSTEM #3 | | | |
|---|---|---|---|---|---|---|---|---|---|---|---|
| OPENING DEGREE OF EXPANSION DEVICE | | 71% | | OPENING DEGREE OF EXPANSION DEVICE | | 100% | | OPENING DEGREE OF EXPANSION DEVICE | | 57% | |
| FCU NUMBER | FCU PERFORMANCE | OPENING DEGREE OF THREE-WAY VALVE | | FCU NUMBER | FCU PERFORMANCE | OPENING DEGREE OF THREE-WAY VALVE | | FCU NUMBER | FCU PERFORMANCE | OPENING DEGREE OF THREE-WAY VALVE | |
| | | FCU OPENING DEGREE | BYPASS OPENING DEGREE | | | FCU OPENING DEGREE | BYPASS OPENING DEGREE | | | FCU OPENING DEGREE | BYPASS OPENING DEGREE |
| 21a | 1kW | 20% | 80% | 21d | 3kW | 43% | 57% | 21g | 4kW | 100% | 0% |
| 21b | 2kW | 40% | 60% | 21e | 7kW | 100% | 0% | 21h | 1kW | 25% | 75% |
| 21c | 5kW | 100% | 0% | 21f | 1kW | 14% | 86% | 21i | 2kW | 50% | 50% |

FIG. 19

| SYSTEM #1 | | | | SYSTEM #2 | | | | SYSTEM #3 | | | |
|---|---|---|---|---|---|---|---|---|---|---|---|
| FCU NUMBER | FCU PERFORMANCE | OPENING DEGREE OF THREE-WAY VALVE | | FCU NUMBER | FCU PERFORMANCE | OPENING DEGREE OF THREE-WAY VALVE | | FCU NUMBER | FCU PERFORMANCE | OPENING DEGREE OF THREE-WAY VALVE | |
| | | FCU OPENING DEGREE | BYPASS OPENING DEGREE | | | FCU OPENING DEGREE | BYPASS OPENING DEGREE | | | FCU OPENING DEGREE | BYPASS OPENING DEGREE |
| 21a | 1kW | 14% | 86% | 21d | 3kW | 43% | 57% | 21g | 4kW | 57% | 43% |
| 21b | 2kW | 28% | 72% | 21e | 7kW | 100% | 0% | 21h | 1kW | 14% | 86% |
| 21c | 5kW | 71% | 29% | 21f | 1kW | 14% | 86% | 21i | 2kW | 29% | 71% |

FIG. 20

| SYSTEM #1 | | | | SYSTEM #2 | | | | SYSTEM #3 | | | |
|---|---|---|---|---|---|---|---|---|---|---|---|
| FCU NUMBER | FCU PERFORMANCE | OPENING DEGREE OF THREE-WAY VALVE | | FCU NUMBER | FCU PERFORMANCE | OPENING DEGREE OF THREE-WAY VALVE | | FCU NUMBER | FCU PERFORMANCE | OPENING DEGREE OF THREE-WAY VALVE | |
| | | FCU OPENING DEGREE | BYPASS OPENING DEGREE | | | FCU OPENING DEGREE | BYPASS OPENING DEGREE | | | FCU OPENING DEGREE | BYPASS OPENING DEGREE |
| 21a | 1kW | 20% | 80% | 21d | 3kW | 43% | 57% | 21g | 4kW | 57% | 0% |
| 21b | 2kW | 40% | 80% | 21e | 7kW | 100% | 0% | 21h | 1kW | 25% | 75% |
| 21c | 5kW | 71% | 0% | 21f | 1kW | 14% | 86% | 21i | 2kW | 50% | 50% |

AIR-CONDITIONING APPARATUS

CROSS REFERENCE TO RELATED APPLICATION

This application is a U.S. national stage application of PCT/JP2018/008000 filed on Mar. 2, 2018, the contents of which are incorporated herein by reference.

TECHNICAL FIELD

The present disclosure relates to an air-conditioning apparatus that causes heat exchange to be performed between refrigerant that circulates in a refrigerant circuit and a heat medium that circulates in a heat medium circuit.

BACKGROUND ART

In the past, as a variable refrigerant flow system, a direct expansion type air-conditioning apparatus, but a water-type air-conditioning apparatus has been used (see, for example, Patent Literature 1). In the water-type air-conditioning apparatus, heat exchange is performed between refrigerant in a primary circuit and a heat medium in a secondary circuit, such as water, thereby heating or cooling the heat medium. The heated or cooled heat medium is transferred to a fail coil unit that is an indoor unit, to perform cooling operation or heating operation.

In an air-conditioning apparatus described in Patent Literature 1, generally, a plurality of fan coil units of a secondary circuit are connected in parallel. The flow rate of water is adjusted for each of indoor units, whereby fan coil units can individually set the temperature of cooling air or heating air.

CITATION LIST

Patent Literature

Patent Literature 1: International Publication No. WO 2014/083652

SUMMARY OF INVENTION

Technical Problem

However, as described in Patent Literature 1, in the case where the plurality of indoor units are connected in parallel, a large amount of heat remains in return water that flows out from the fail coil units. Therefore, an energy use efficiency is reduced, and an energy efficiency for energy savings is reduced.

The present disclosure is applied to solve the problem of such an existing air-conditioning apparatus as described above, and relates to an air-conditioning apparatus that efficiently uses heat of a heat medium that flows out of a heat exchanger, and can improve an energy efficiency for energy savings.

Solution to Problem

An air-conditioning apparatus according to an embodiment of the present disclosure includes a plurality of indoor units. Each of the indoor units includes a heat-medium flow adjusting valve and a heat exchanger. The heat-medium flow adjusting valve adjusts the flow rate of a heat medium that flows into the heat-medium flow adjusting valve, and causes the heat medium to flow out of the heat-medium flow adjusting valve. The heat exchanger causes heat exchange to be performed between the heat medium and air. The heat medium flows into the heat exchanger from an inflow side of the heat exchanger. The inflow side of the heat exchanger is connected to an outflow side of the heat-medium flow adjusting valve. The plurality of indoor units are connected in series.

Advantageous Effects of Invention

According to the embodiment of the present disclosure, a heat medium subjected to heat exchange is made to flow into heat exchangers connected in series. Thus, heat of the heat medium is used by the plurality of indoor units. That is, the heat of the heat medium can be efficiently used.

BRIEF DESCRIPTION OF DRAWINGS

FIG. 12 is a schematic view indicating opening degrees of heat-medium flow adjusting valves that are associated with the FCUs of a system #1 as illustrated in FIG. 11.

FIG. 13 is a schematic view indicating the opening degrees of the heat-medium flow adjusting valves 22 in the case where a FCU is made to be in a thereto-off state.

FIG. 14 is a schematic view indicating the opening degrees of the heat-medium flow adjusting valves in the case where the FCU performance of a FCU, which is a representative FCU, varies.

FIG. 17 is a schematic view indicating a first example of the opening degrees of the heat-medium flow adjusting valves in the case where representative FCUs in systems #1 to #3 have different FCU performance.

FIG. 18 is a schematic view illustrating a second example of the opening degrees of the heat-medium flow adjusting valves in the case where the representative FCUs of systems #1 to #3 have different FCU performance.

FIG. 19 is a schematic view illustrating a third example of the opening degrees of the heat-medium flow adjusting valves in the case where the representative FCUs in the respective systems #1 to #3 have different FCU performance.

FIG. 20 is a schematic view illustrating a fourth example of the opening degrees of the heat-medium flow adjusting valves in the case where the representative FCUs in the respective systems #1 to #3 have different FCU performance.

DESCRIPTION OF EMBODIMENTS

Embodiment 1

Figure 1:
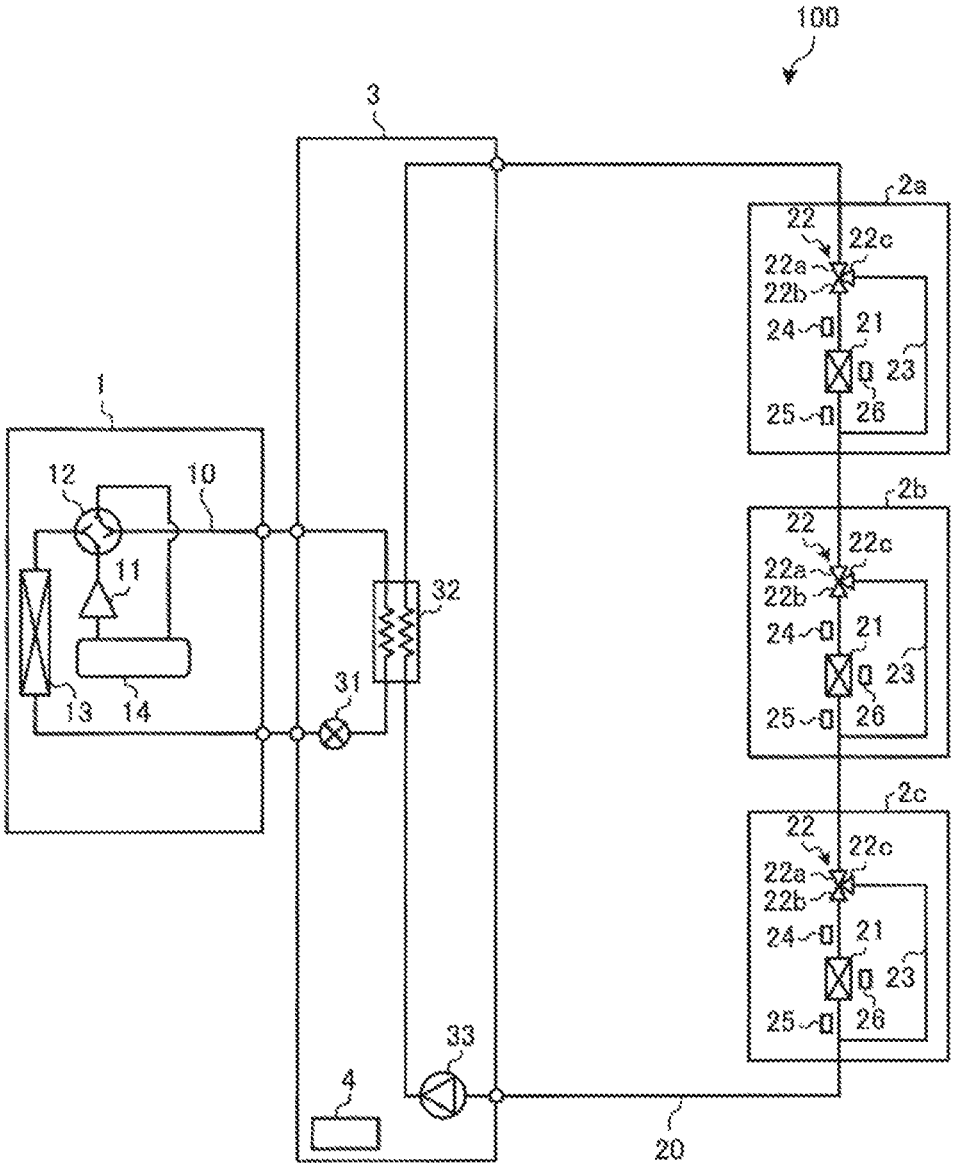
FIG. 1 is a schematic view illustrating an example of the configuration of an air-conditioning apparatus according to Embodiment 1.

An air-conditioning apparatus according to Embodiment 1 of the present disclosure will be described. FIG. 1 is a schematic view illustrating an example of the configuration of an air-conditioning apparatus 100 according to Embodiment 1. As illustrated in FIG. 1, the air-conditioning apparatus 100 includes an outdoor unit 1, indoor units 2*a* to 2*c*, and a relay unit 3. The outdoor unit 1 and the relay unit 3 are connected by a refrigerant pipe 10, whereby a refrigerant circuit is formed. The indoor units 2*a* to 2*c* and the relay unit 3 are connected by a heat medium pipe 20, whereby a heat medium circuit is formed. The indoor units 2*a* to 2*c* are connected in series.

[Configuration of Air-Conditioning Apparatus 100]

(Outdoor Unit 1)

The outdoor unit 1 includes a compressor 11, a refrigerant-flow switching device 12, a heat-source-side heat exchanger 13, and an accumulator 14. The compressor 11 sucks low-temperature, low pressure refrigerant, compresses the sucked refrigerant into high-temperature, high-pressure refrigerant, and discharges the high-temperature, high-pressure refrigerant. For example, the compressor 11 is, for example, an inverter compressor the capacity of which is controlled by changing its operating frequency. It should be noted that this capacity is the amount of refrigerant that is discharged per unit time. The operating frequency of the compressor 11 is controlled by a controller 4 provided in the relay unit 3, which will be described later.

The refrigerant-flow switching device 12 is, for example, a four-way valve, and switches the flow direction of refrigerant to switch the operation to be performed between a cooling operation and a heating operation. During the cooling operation, a flow passage in the refrigerant-flow switching device 12 is switched such that the discharge side of the compressor 11 and the heat-source-side heat exchanger 13 are connected to each other as indicated by a solid line in FIG. 1. During the heating operation, the flow passage in the refrigerant-flow switching device 12 is switched such that the discharge side of the compressor 11 and the relay unit 3 are connected to each other as indicated by a broken line in FIG. 1. Switching of the flow passage in the refrigerant-flow switching device 12 is controlled by the controller 4.

The heat-source-side heat exchanger 13 causes heat exchange to be performed between refrigerant and outdoor air that is supplied by, for example, a fan (not illustrated). During the cooling operation, the heat-source-side heat exchanger 13 operates as a condenser that transfers heat of the refrigerant to outdoor air to condense the refrigerant. During the heating operation, the heat-source-side heat exchanger 13 operates as an evaporator that evaporates the refrigerant to cool the outdoor air by heat of vaporization produced when the refrigerant is evaporated.

The accumulator 14 is provided on a low-pressure side of the compressor 11 that is a suction side of the compressor 11. The accumulator 14 separates surplus refrigerant the amount of which corresponds to the difference between the amount of the refrigerant that flows during the cooling operation and the amount of the refrigerant that flows during the heating operation, or surplus refrigerant the amount of which corresponds to the difference between the amount of the refrigerant that flows after a transient change of the operation and the amount of the refrigerant that flows before the transient change of the operation, into gas refrigerant and liquid refrigerant, and then stores the liquid refrigerant.

(Indoor Units 2*a* to 2*c*)

Figure 2:
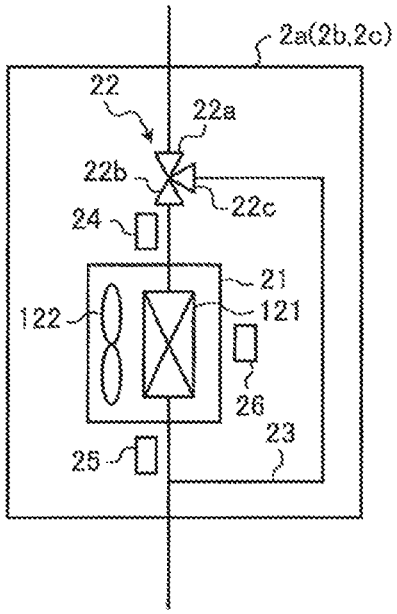
FIG. 2 is a schematic view illustrating an example of the configuration of an indoor unit as illustrated in FIG. 1.

FIG. 2 is a schematic view illustrating an example of the configuration of the indoor unit 2*a* to 2*c* as illustrated in FIG. 1. As illustrated in FIG. 2, each of the indoor units 2*a* to 2*c* includes a fan coil unit (hereinafter referred to as "FCU") 21 and a heat-medium flow adjusting valve 22.

The FCU 21 includes a use-side heat exchanger 121 and a fan 122. The use-side heat exchanger 121 causes heat exchange to be performed between water and indoor air that is supplied by the fan 122. As a result, cooling air or heating air is generated as conditioned air to be supplied into an indoor space. The fan 122 supplies air to the use-side heat exchanger 121. The rotation speed of the fan 122 is controlled by the controller 4. The amount of air that is supplied to the use-side heat exchanger 121 is controlled by controlling the rotation speed.

The heat-medium flow adjusting valve 22 is, for example, an electric three-way valve having an inflow port 22*a*, a first outflow port 22*b*, and a second outflow port 22*c*, and is provided on a water inflow side of the FCU 21. The heat-medium flow adjusting valve 22 is provided to divide water that has flowed into the heat-medium flow adjusting valve 22. The first outflow port 22*b* of the heat-medium flow adjusting valve 22 is connected to the water inflow side of the FCU 21. The second outflow port 22*c* is connected to the water outflow side of the FCU 21 by a bypass pipe 23. Therefore, the second outflow port 22*c* of the heat-medium flow adjusting valve 22 and the water outflow side of the FCU 21 are connected.

In this example, in the indoor unit 2*a* to 2*c*, respective bypass pipes 23 are provided. This, however, is not limiting. The bypass pipes 23 may be provided to extend through regions located outside the indoor unit 2*a* to 2*c*. As a result, the length of the bypass pipe 23 is shortened. It is therefore possible to reduce a loss caused by heat radiation that occurs when water flows through the pipe. Furthermore, it is not necessarily indispensable that the bypass pipes 23 are provided in all the indoor units 2*a* to 2*c*. For example, of the FCUs 21, a FCU 21 or FCUs 21 may be provided with an indoor-side bypass pipe or pipes 23 in the case where the FCU 21 or FCUs 21 do not need to cause water to flow therethrough.

In the case where the heat-medium flow adjusting valve 22 includes at least the inflow port 22*a*, the first outflow port 22*b*, and the second outflow port 22*c*, the heat-medium flow adjusting valve 22 may be a multi-way valve such as a four-way valve. To be more specific, for example, as the heat-medium flow adjusting valve 22, a four-way valve may be used, and the four-way valve may be used as a pseudo three-way valve by using an outflow port other than the first outflow port 22*b* and the second outflow port 22*c*, for other applications, or by closing the outflow port other than the first outflow port 22*b* and the second outflow port 22*c* in order to inhibit use of the outflow port. It should be noted that as in Embodiment 1, it is optimal that the heat-medium flow adjusting valve 22 is a three-way valve having a flow rate control function and a block function that can be fulfilled by adjusting the opening degree of the valve, that is, can divide water that flows into the heat-medium flow adjusting valve 22, while adjusting the flow rate of the water, and that can block each of the divided water. Instead of using the heat-medium flow adjusting valve 22, it may be possible to use, for example, a combination of a three-way valve that controls the flow rate and an expansion device that blocks flowing water. Alternatively, for example, at a location between a branch point and a junction of a pipe provided on the inflow side of the FCU 21 and at the bypass pipe 23, respective expansion units may be provided.

Furthermore, each of the indoor units 2*a* to 2*c* includes an inlet temperature sensor 24, an outlet temperature sensor 25, and a suction temperature sensor 26. The inlet temperature sensor 24 is provided on the water inflow side of the FCU 21 to detect the temperature of water that flows into the FCU 21. The outlet temperature sensor 25 is provided on a water outflow side of the FCU 21 to detect the temperature of water that flows out of the FCU 21. The suction temperature sensor 26 is provided on an air suction side of the FCU 21 to detect information on the temperature of air sucked into the FCU 21.

(Relay Unit 3)

The relay unit 3 as illustrated in FIG. 1 includes an expansion valve 31, an intermediate heat exchanger 32, a pump 33, and the controller 4. The expansion valve 31 causes refrigerant to expand. The expansion valve 31 is a valve whose opening degree can be controlled, for example, an electronic expansion valve. The opening degree of the expansion valve 31 is controlled by the controller 4.

The intermediate heat exchanger 32 operates as a condenser or an evaporator, and causes heat exchange to be performed between refrigerant that flows in the refrigerant circuit connected with a refrigerant-side flow passage and a heat medium that flows in the heat medium circuit connected with a heat-medium-side flow passage. During the cooling operation, the intermediate heat exchanger 32 operates as an evaporator that evaporates refrigerant to cool a heat medium by heat of vaporization produced when the refrigerant is evaporated, During the heating operation, the intermediate heat exchanger 32 operates as a condenser that condenses refrigerant by transferring heat of the refrigerant to the heat medium.

The pump 33 is driven by a motor (not illustrated), and circulates water that flows through the heat medium pipe 20 and that is a heat medium. For example, the pump 33 is a pump whose capacity can be controlled. The flow rate of the water that is circulated by the pump 33 can be controlled in accordance with the load on each of the indoor unit 2*a* to 2*c*. The driving of the pump 33 is controlled by the controller 4. More specifically, the pump 33 is controlled by the controller 4 such that the greater the above load, the higher the flow rate of water, and the smaller the load, the lower the flow rate of water.

(Controller 4)

The controller 4 controls the operation of the entire air-conditioning apparatus 100 that includes the outdoor unit 1, the indoor units 2*a* to 2*c*, and the relay unit 3, based on various information that is transmitted from respective units, for example, temperatures at locations upstream and downstream of respective use-side heat exchangers 121 in the air-conditioning apparatus 100, and pressures of a heat medium at locations upstream and downstream of the pump 33. More specifically, the controller 4 controls the operating frequency of the compressor 11, the driving of the pump 33, the opening degrees of the heat-medium flow adjusting valves 22, the opening degree of the expansion valve 31, etc. Particularly, in Embodiment 1, the controller 4 controls the driving of the pump 33 and the opening degrees of the heat-medium flow adjusting valves 22 based on the performance of the FCUs 21.

The controller 4 is hardware, such as a circuit device, that fulfills various functions, or that fulfills various functions by executing software on an arithmetic unit such as a microcomputer. In this example, the controller 4 is provided in the relay unit 3. This, however, is not limiting. The controller 4 may be provided in any one of the outdoor unit 1 and the indoor units 2*a* to 2*c*. Alternatively, the outdoor unit 1 and the indoor units 2*a* to 2*c* may be provided with respective controllers 4.

Figure 3:
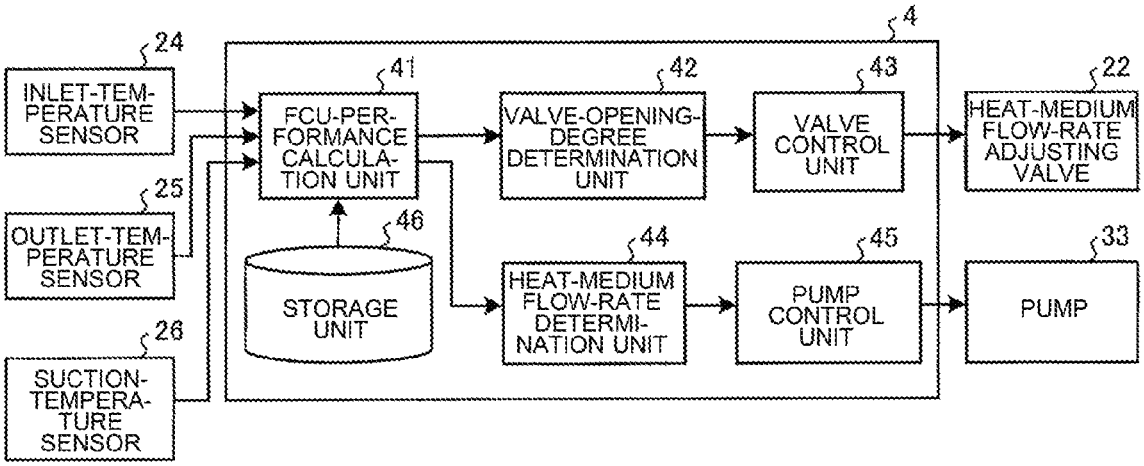
FIG. 3 is a functional block diagram illustrating an example of the configuration of a controller as illustrated in FIG. 1.

FIG. 3 is a functional block diagram illustrating an example of the configuration of the controller 4 as illustrated in FIG. 1. As illustrated in FIG. 3, the controller 4 includes an FCU performance calculation unit 41, a valve opening-degree determination unit 42, a valve control unit 43, a heat-medium flow-rate determination unit 44, a pump control unit 45, and a storage unit 46.

The FCU performance calculation unit 41 calculates FCU performance that each of the FCUs 21 is currently required to achieve. The FCU performance is the operating performance [kW] of the FCU 21 that is required to condition air such that the temperature of the air reaches a set temperature. The FCU performance is calculated based on various temperatures detected by the inlet temperature sensor 24, the outlet temperature sensor 25, and the suction temperature sensor 26, and set FCU performance, a set outlet/inlet temperature difference, and a set water/air temperature difference that are stored in the storage unit 46.

The set FCU performance is FCU performance set in advance for the FCU 21. The set outlet/inlet temperature difference is a set temperature difference between the outlet temperature of water that flows out of the FCU 21 and the inlet temperature of water that flows into the FCU 21. The set water/air temperature difference is a set temperature difference between the temperature of air that is sucked into the FCU 21 and the inlet temperature of water that flows into the FCU 21.

Based on the calculated FCU performance of each FCU 21, the valve opening-degree determination unit 42 determines the opening degree of an associated heat-medium flow adjusting valve 22. The valve control unit 43 produces a control signal for controlling the opening degree of the above associated heat-medium flow adjusting valve 22 based on the opening degree determined by the valve opening-degree determination unit 42, and the valve control unit 43 sends the control signal to the heat-medium flow adjusting valve 22.

The heat-medium flow-rate determination unit 44 determines the flow rate of water that flows into each FCU 21 based on the calculated FCU performance of each FCU 21, To be more specific, the heat-medium flow-rate determination unit 44 determines the flow rate of water such that the higher the FCU performance, the higher the flow rate of water that is made to flow into the FCU 21, and the lower the FCU performance, the lower the flow rate of water that is made to flow into the FCU 21. The pump control unit 45 produces a control signal for controlling the driving of the pump 33 based on the flow rate of water determined by the heat-medium flow-rate determination unit 44, and the pump control unit 45 sends the control signal to the pump 33.

The set FCU performance, the set outlet/inlet temperature difference, and the set water/air temperature differences which are all referred to by the FCU performance calculation unit 41, are stored in advance in the storage unit 46.

[Configuration of Heat-Medium Flow Adjusting Valve 22]

Figure 4:
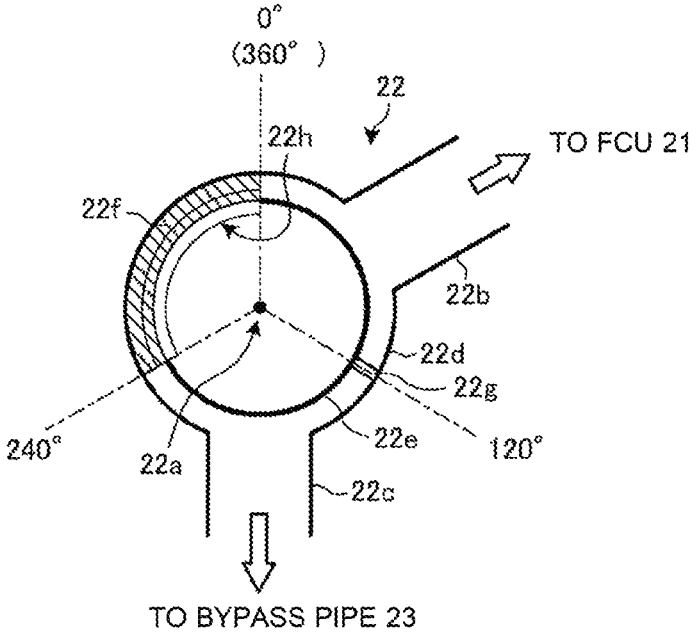
FIG. 4 is a top cross-sectional view illustrating an example of the configuration of a heat-medium flow adjusting valve as illustrated in FIG. 1.

FIG. 4 is a top cross-sectional view illustrating an example of the configuration of the heat-medium flow adjusting valve 22 as illustrated in FIG. 1. As illustrated in FIG. 4, the heat-medium flow adjusting valve 22 includes a body 22*d* having a hollow columnar shape, and the inflow port 22*a* that is located at a center portion of an upper surface or a bottom surface of the body 22*d*. The inflow port 22*a* is a port through which a heat medium flows into the heat-medium flow adjusting valve 22. Furthermore, in a side surface of the body 22*d* of the heat-medium flow adjusting valve 22, the first outflow port 22*b* and the second outflow port 22*c* through which the heat medium flows out are provided.

The first outflow port 22*b* is connected with the FCU 21, and the second outflow port 22*c* is connected with the bypass pipe 23. In the case where the side surface of the body 22*d* is divided into regions arranged at an intervals of an angle of 120 degrees, that is, regions each curved through an angle of 120 degrees about the center axis, which is the normal to the upper surface or the bottom surface of the body 22*d*, the side surface of the body 22*d* is divided into the following three regions: a first region curved from a position corresponding to 0 degree to a position corresponding to 120 degrees; a second region curved from the position corresponding to 120 degrees to a position corresponding to 240 degrees; and a third region curved from the position corresponding to 240 degrees to a position corresponding to 360 degrees. The first outflow port 22*b* is formed in the first region of the above three regions of the side surface. The second outflow port 22*c* is formed in the second region of the three regions of the side surface.

An opening-degree adjusting valve 22*e* having a cylindrical shape is provided in the internal space of the body 22*d*. The opening-degree adjusting valve 22*e* has an opening portion 22*h*, which is an opening formed in part of the opening-degree adjusting valve 22*e* that corresponds to part of an arc cross section thereof, and the opening portion 22*h* has a C-shaped cross section. The opening portion 22*h* extends in such a manner to curve about the center axis through 120 degrees.

In the heat-medium flow adjusting valve 22, a side wall 22*f* is provided on an inner periphery of a side surface located in the third region of the above divided regions, that is, the first to third regions, such that the side wall 22*f* has a greater thickness than side surfaces provided in the first and second regions. The side wall 22*f* is provided in such a manner as to contact an outer periphery of the opening-degree adjusting valve 22*e*, Furthermore, a partition wall 22*g* is provided on an inner periphery of a side surface located at a boundary portion between the first region and the second region such that the partition wall 22*g* contacts the opening-degree adjusting valve 22*e*. The partition wall 22*g* divides water that has flowed into the heat-medium flow adjusting valve 22 through the inflow port 22*a* such that the divided water flows out from the first outflow port 22*b* and also flows out from the second outflow port 22*c*.

The opening-degree adjusting valve 22*e* is rotated along the side wall 22*f* and the partition wall 22*g* about the center axis. Since the heat-medium flow adjusting valve 22 is formed in the above manner, flow passages that each allows water to flow therethrough in accordance with a rotation state of the opening-degree adjusting valve 22*e* are provided between the inflow port 22*a* and the first outflow port 22*b* and between the inflow port 22*a* and the second outflow port 22*c*.

FIGS. 5 to 10 are top cross-sectional views schematically illustrating respective states in which the opening-degree adjusting valve 22*e* of the heat-medium flow adjusting valve 22 as illustrated in FIG. 4 is rotated. It should be noted that the opening degree of the opening-degree adjusting valve 22*e* that is opened to allow the inflow port 22*a* and the first outflow port 22*b* to communicate with each other and thus allow water to flow from the inflow port 22*a* to the first outflow port 22*b* will be referred to as "FCU opening degree". Furthermore, the opening degree of the opening-degree adjusting valve 22*e* that is opened to allow the inflow port 22*a* and the second outflow port 22*c* to communicate with each other and thus allow water to flow to the second outflow port 22*c* through the inflow port 22*a* will be referred to as "bypass opening degree".

Figure 5:
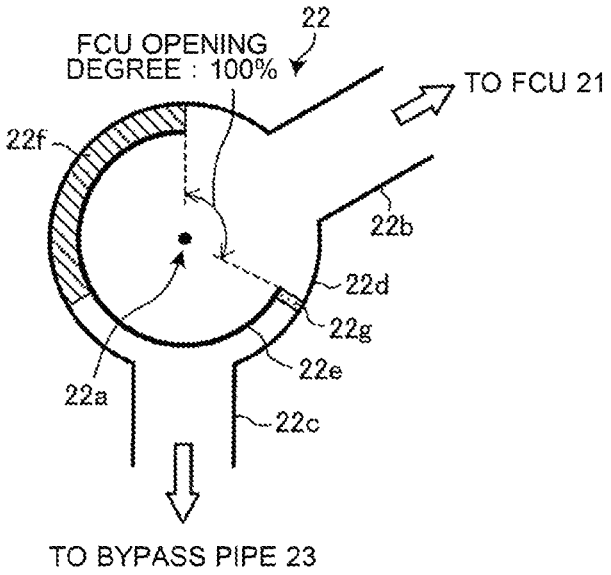
FIG. 5 is a top cross-sectional view schematically illustrating a first state of the heat-medium flow adjusting valve as illustrated in FIG. 4.

FIG. 5 is a top cross-sectional view schematically illustrating a first state of the heat-medium flow adjusting valve 22 as illustrated in FIG. 4. In the first state, the location of the opening portion 22*h* of the opening-degree adjusting valve 22*e* coincides with that of a region between one end portion of the side wall 22*f* and the partition wall 22*g*. In this case; the opening degree of the heat-medium flow adjusting valve 22 is set such that the FCU opening degree is 100% and the bypass opening degree is 0%. That is, the flow rate of water that flows out through the first outflow port 22*b* is 100% of the flow rate of water that flows into the inflow port 22*a*.

Figure 6:
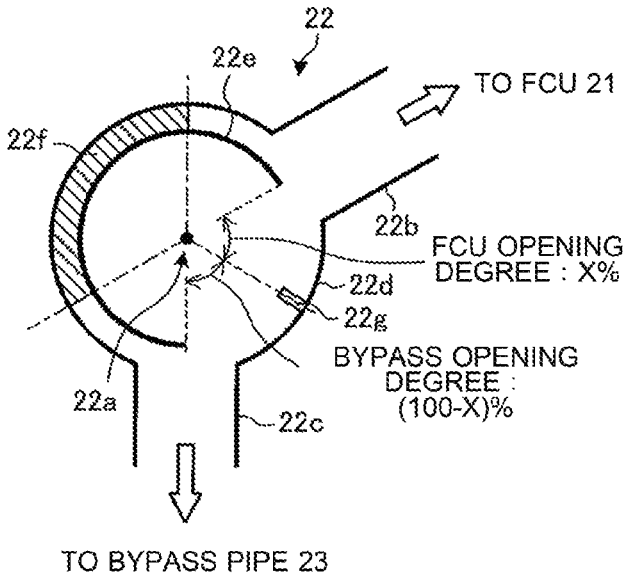
FIG. 6 is a top cross-sectional view schematically illustrating a second state of the heat-medium flow adjusting valve as illustrated in FIG. 4.

FIG. 6 is a top cross-sectional view schematically illustrating a second state of the heat-medium flow adjusting valve 22 as illustrated in FIG. 4. The second state is a state to which the state of the opening-degree adjusting valve 22*e* is changed from the first state when the opening-degree adjusting valve 22*e* is rotated from the position thereof in the first state in a clockwise direction such that the opening portion 22*h* of the opening-degree adjusting valve 22*e* faces the partition wall 22*g*. In this case; the opening degree of the heat-medium flow adjusting valve 22 is set such that the FCU opening degree is X % and the bypass opening degree is (100−X) %. That is, the flow rate of water that flows out through the first outflow port 22*b* is X % of the flow rate of water that flows into the inflow port 22*a*, Furthermore, the flow rate of water that flows out through the second outflow port 22*c* is (100−X) % of the flow rate of water that flows into the inflow port 22*a*.

Figure 7:
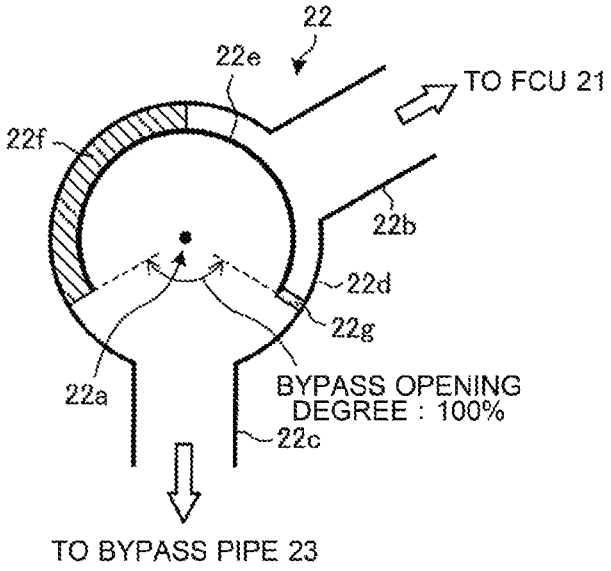
FIG. 7 is a top cross-sectional view schematically illustrating a third state of the heat-medium flow adjusting valve as illustrated in FIG. 4.

FIG. 7 is a top cross-sectional view schematically illustrating a third state of the heat-medium flow adjusting valve 22 as illustrated in FIG. 4. The third state is a state to which the state of the opening-degree adjusting valve 22*e* is changed from the second state when the opening-degree adjusting valve 22*e* is rotated from the position thereof in the second state in the clockwise direction, and in which the location of the opening portion 22*h* of the opening-degree adjusting valve 22*e* coincides with that of a region between the partition wall 22*g* and the other end portion of the side wall 22*f*. In this case, the opening degree of the heat-medium flow adjusting valve 22 is set such that the FCU opening degree is 0% and the bypass opening degree is X %. That is, the flow rate of water that flows out through the second outflow port 22*c* is 100% of the flow rate of water that flows into the inflow port 22*a*.

Figure 8:
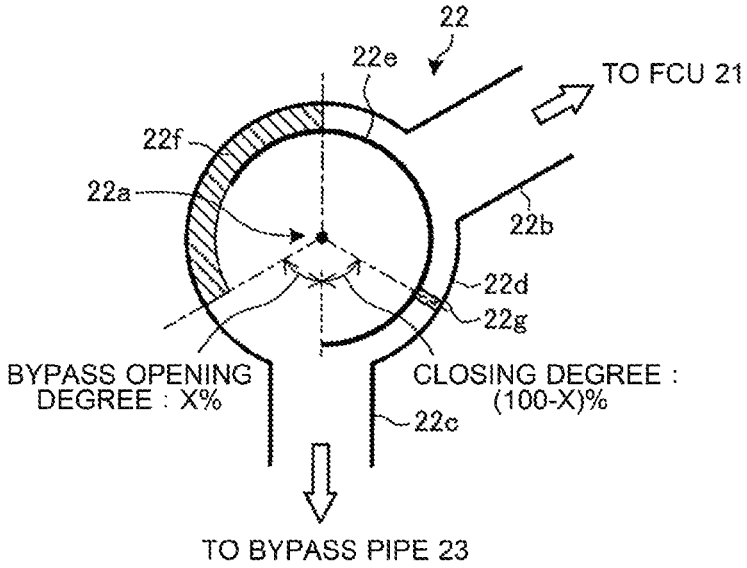
FIG. 8 is a top cross-sectional view schematically illustrating a fourth state of the heat-medium flow adjusting valve as illustrated in FIG. 4

FIG. 8 is a top cross-sectional view schematically illustrating a fourth state of the heat-medium flow adjusting valve 22 as illustrated in FIG. 4. The fourth state is a state to which the state of the opening-degree adjusting valve 22*e* is changed from the third state when the opening-degree adjusting valve 22*e* is rotated from the position thereof in the third state in the clockwise direction, and the opening portion 22*h* of the opening-degree adjusting valve 22*e* faces the other end portion of the side wall 22*f*. In this case, the opening degree of the heat-medium flow adjusting valve 22 is set such that the FCU opening degree is 0% and the bypass opening degree is X %. That is, the flow rate of water that flows out through the second outflow port 22*c* is X % of the flow rate of water that flows into the inflow port 22*a*.

Figure 9:
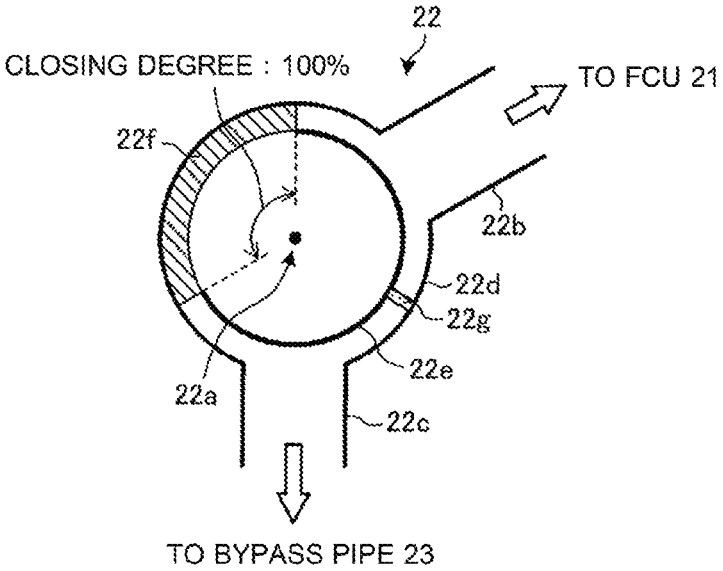
FIG. 9 is a top cross-sectional view schematically illustrating a fifth state of the heat-medium flow adjusting valve as illustrated in FIG. 4.

FIG. 9 is a top cross-sectional view schematically illustrating a fifth state of the heat-medium flow adjusting valve 22 as illustrated in FIG. 4, The fifth state is a state to which the state of the opening-degree adjusting valve 22*e* is changed from the fourth state when the opening-degree adjusting valve 22*e* is rotated from the position thereof in the fourth state in the clockwise direction, and in which the location of the opening portion 22*h* of the opening-degree adjusting valve 22*e* coincides with that of a region between the above one end portion and the other end portion of the side wall 22*f*. In this case, the opening degree of the heat-medium flow adjusting valve 22 is set such that the FCU opening degree is 0% and the bypass opening degree is 0%, That is, water that flows into the inflow port 22*a* is completely blocked, that is, completely inhibited from flowing out. For example, when space where an indoor unit 2 including a FCU 21 is installed does not need to be air-conditioned, the flow of water to the indoor unit 2 is blocked by setting the opening degree of the heat-medium flow adjusting valve 22 as illustrated in FIG. 9. Therefore, the load on the pump 33 can be reduced.

Figure 10:
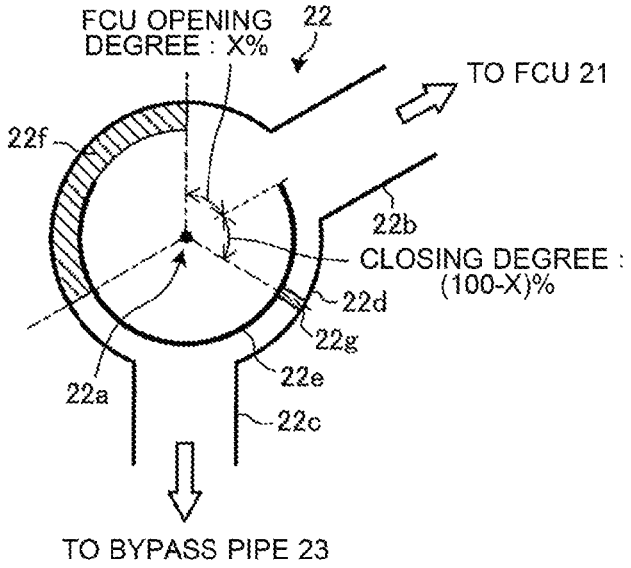
FIG. 10 is a top cross-sectional view schematically illustrating a sixth state of the heat-medium flow adjusting valve as illustrated in FIG. 4.

FIG. 10 is a top cross-sectional view schematically illustrating a sixth state of the heat-medium flow adjusting valve 22 as illustrated in FIG. 4. The sixth state is a state to which the state of the opening-degree adjusting valve 22*e* is changed from the fifth state when the opening-degree adjusting valve 22*e* is rotated from the position thereof in the fifth state in the clockwise direction, and in which the opening portion 22*h* of the opening-degree adjusting valve 22*e* face the above one end portion of the side wall 22*f*. In this case, the opening degree of the heat-medium flow adjusting valve 22 is set such that the FCU opening degree is X % and the bypass opening degree is 0%. That is, the flow rate of water that flows out through the first outflow port 22*b* is X % of the flow rate of water that flows into the inflow port 22*a*.

In the above manner, the heat-medium flow adjusting valve 22 is controlled in opening degree, thereby allowing water that has flowed into the inflow port 22*a* to flow out from both the first outflow port 22*b* and the second outflow port 22*c* at a controlled flow rate.

[Operation of Air-Conditioning Apparatus 100]

Next, the operation of the air-conditioning apparatus 100 having the above configuration will be described. In the following explanation, the flow of water serving as a heat medium that circulates in the heat medium circuit and a flow-rate control process in the indoor unit 2*a* to 2*c* are described.

(Flow of Heat Medium)

Figure 11:
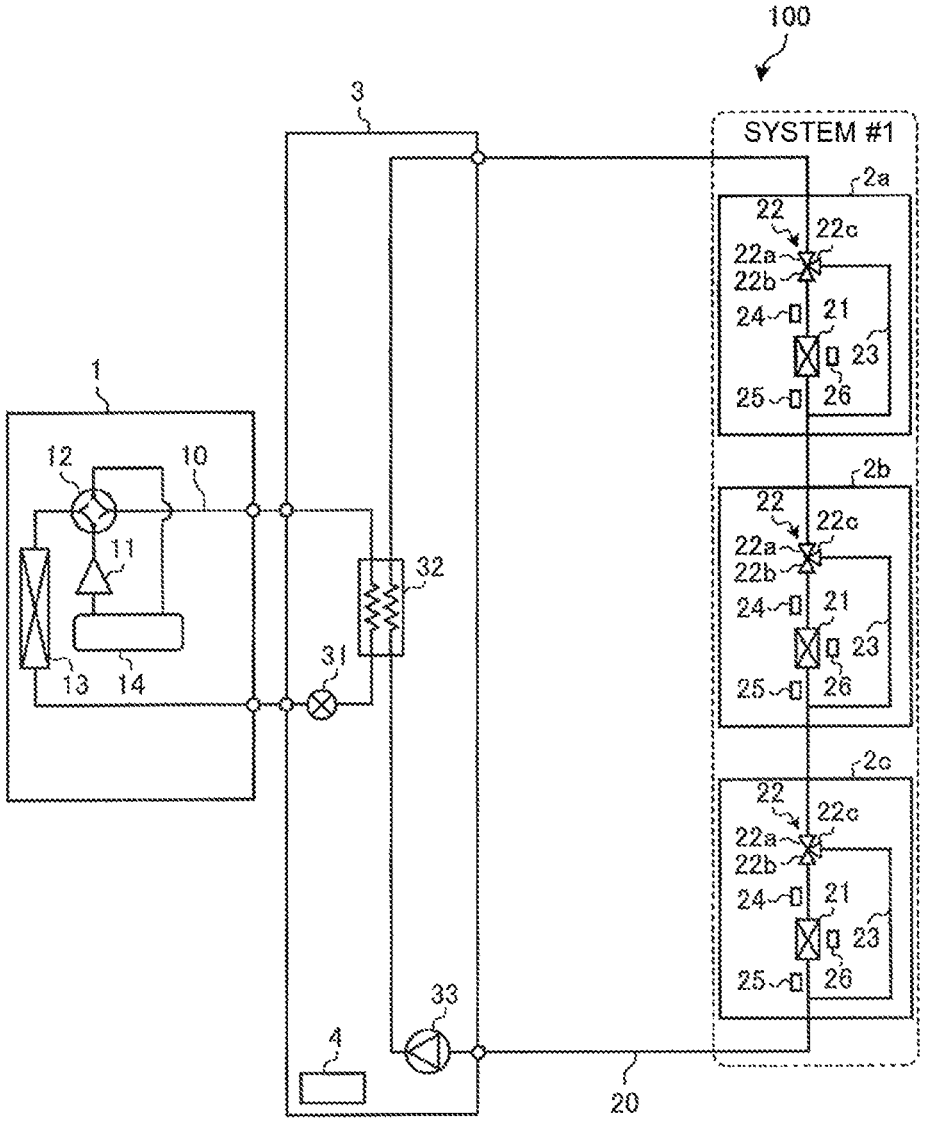
FIG. 11 is a schematic view for explaining the flow of a heat medium.

FIG. 11 is a schematic view for explaining the flow of a heat medium. FIG. 11 illustrates an example of a circuit configuration in the case where three indoor units 2 are connected in series in the air-conditioning apparatus 100. It should be noted that a group including the indoor units 2 connected in series will be referred to as "system". That is, the air-conditioning apparatus 100 as illustrated in FIG. 11 is configured such that a system #1 includes the indoor units 2*a* to 2*c* connected in series, and the system #1 is connected parallel to the relay unit 3.

In the relay unit 3, water that has flowed out from the intermediate heat exchanger 32 flows out of the relay unit 3 through the heat medium pipe 20. The water that has flowed out of the relay unit 3 flows into the indoor unit 2*a* that is located on the most upstream side in the system #1.

In the indoor unit 2*a* of the system #1, water that has flowed into the indoor unit 2*a* flows through an FCU 21*a* or the bypass pipe 23 at a flow rate that depends on the set opening degree of the heat-medium flow adjusting valve 22. The water that has flowed into the FCU 21*a* exchanges heat with indoor air to receive heat from or transfer heat to the indoor air, thereby cooling or heating the indoor air, and the water then flows out from the FCU 21*a*. The water that has flowed out of the FCU 21*a* and the water that has flowed through the bypass pipe 23 joins each other at a location downward of the FCU 21*a*, and flows into the indoor unit 2*b* that is provided downstream of the indoor unit 2*a*.

In the indoor unit 2*b*, the water that has flowed into the indoor unit 2*b* flows through an FCU 21*b* or the bypass pipe 23 at a flow rate that depends on the set opening degree of the heat-medium flow adjusting valve 22. The water that has flowed into the FCU 21*b* exchanges heat with indoor air to receive heat from or transfer heat to the indoor air, thereby cooling or heating the indoor air, and the water then flows out of the FCU 21*b*. The water that has flowed out of the FCU 21*b* and the water that flows in the bypass pipe 23 join each other at a location downstream of the FCU 21*b*, and flow into the indoor unit 2*c* that is provided downstream of the indoor unit 2*b*.

In the indoor unit 2*c*, the water that has flowed into the indoor unit 2*c* flows through an FCU 21*c* or the bypass pipe 23 at a flow rate that depends on the set opening degree of the heat-medium flow adjusting valve 22. The water that has flowed into the FCU 21*c* exchanges heat with indoor air to receive heat from or transfer heat to the indoor air, thereby cooling or heating the indoor, and the water then flows out of the FCU 21*c*. The water that has flowed out of the FCU 21*c* and the water that flows in the bypass pipe 23 join each other at a location downstream of the FCU 21*c*, and then flow out of the indoor unit 2*c*.

The water that has flowed out of the indoor unit 2*c* flows into the relay unit 3 through the heat medium pipe 20. The water that has flowed into the relay unit 3 flows into the intermediate heat exchanger 32 via the pump 33. Thereafter, the above circulation is repeated, (Flow-Rate Control Process)

The following description is made regarding a flow-rate control process of adjusting the flow rate of water that flows into the FCU 21 of each of the indoor units 2*a* to 2*c*. When water flows into the FCU 21 at a rate such that the water causes an air conditioning performance to be higher than a required FCU performance, heat of water cannot be fully used, and heat remains in water that has passed through the FCU 21. Therefore, a heat usage efficiency for transfer power is educed.

In view of the above, in Embodiment 1, the air-conditioning apparatus 100 performs the flow-rate control process of adjusting the flow rate of water for each FCU 21 in the system #1 to cause water to flow into each FCU 21 at a required flow rate. In the flow-rate control process, the opening degrees of the heat-medium flow adjusting valves 22 that are associated with the respective FCUs 21 are controlled to adjust the flow rates of water for the FCUs 21.

The flow rate of water that flows into the FCU 21 can be calculated based on the difference between the pressure of water before passage of the water through the heat-medium flow adjusting valve 22 and that after passage of the water through the heat-medium flow adjusting valve 22 and a Cv value indicating characteristics of the heat-medium flow adjusting valve 22. The Cv value is a value determined based on the type of the heat-medium flow adjusting valve 22 and the diameter of a port of the heat-medium flow adjusting valve 22, and is a capacity coefficient of the heat-medium flow adjusting valve 22. The Cv value is a numerical value indicating the flow rate of a fluid that passes through the heat-medium flow adjusting valve 22 at a certain differential pressure. The flow rate of water increases as the Cv value increases. The flow rate of water decreases as the Cv value decreases.

The FCU performance calculation unit 41 calculates FCU performance that the FCUs 21 in the system #1 are currently required to achieve. The FCU performance of each FCU 21 is calculated based on formula (1) using set FCU performance set in advance for each FCU 21, an inlet temperature of water that flows into the FCU 21, an outlet temperature of water that flows out of the FCU 21, and the temperature of indoor air sucked by the fan 122.

FCU performance=set FCU performance×(outlet/inlet temperature difference/set outlet/inlet temperature difference)×(water/air temperature difference/set water/air temperature difference)

In formula (1), the outlet/inlet temperature difference is the temperature difference between a current outlet temperature of water that flows out of the FCU 21 and a current inlet temperature of water that flows into the FCU 21. The water/air temperature difference is the temperature difference between a current temperature of air that is sucked into the FCU 21 and a current inlet temperature of water that flows into the FCU 21.

Next, the valve opening-degree determination unit 42 determines, as a representative FCU of the system #1, a FCU 21 having the highest calculated FCU performance among the FCUs 21 in the system #1. Then, the valve opening-degree determination unit 42 determines the opening degree of the heat-medium flow adjusting valve 22 that is associated with the representative FCU such that the opening degree is set to the opening degree of the heat-medium flow adjusting valve 22 opened such that the heat-medium flow adjusting valve 22 is fully opened toward the FCU 21. The valve opening-degree determination unit 42 also determines the opening degrees of the heat-medium flow adjusting valves 22 that are associated with the FCUs 21 other than the representative FCU based on the ratios of the performance of the FCUs 21 other than the representative FCU to that of the representative FCU.

FIG. 12 is a schematic view illustrating the opening degrees of the heat-medium flow adjusting valves 22 that are associated with the FCUs 21*a* to 21*c* of the system #1 as illustrated in FIG. 11. The FCU number indicated in FIG. 12 is a number assigned to each FCU 21 in the system #1. In the figure, reference sings denoting the respective FCUs 21 in the system #1 are indicated; the FCU performance is the FCU performance of each FCU 21; and the opening degree of the heat-medium flow adjusting valve is the opening degree of each of the heat-medium flow adjusting valves 22 that are associated with the respective FCUs 21, and the opening degrees for the FCU 21 and for the bypass pipe 23 are also indicated.

As illustrated in FIG. 12, of the FCU performance of the FCUs 21*a* to 21*c* in the system #1, the FCU performance of the FCU 21*c* is 5 kW, which is the highest FCU performance in the system #1. Therefore, the valve opening-degree determination unit 42 determines the FCU 21*c* as the representative FCU of the system #1. Then, the valve opening-degree determination unit 42 sets the FCU opening degree of the heat-medium flow adjusting valve 22 that is associated with the FCU 21*c* to 100%, which is the opening degree of the valve opening-degree determination unit 42 opened such that the heat-medium flow adjusting valve 22 is fully opened toward the FCU 21*c*.

On the other hand, the FCU performance of each of the FCU 21*a* and the FCU 21*b* is 1 kW, which is ⅕ of the FCU performance of the FCU 21*c*. Therefore, based on the performance ratio of the FCU performance of each of the FCU 21*a* and 21*b* to that of the FCU 21*c*, the valve opening-degree determination unit 42 determines that the FCU opening degrees of the heat-medium flow adjusting valves 22 that are associated with the respective FCUs 21*a* and 21*b* are 20% (=100%×⅕), and the bypass opening degrees of the heat-medium flow adjusting valves 22 are 80%.

The following description is made with respect to the case where any of the FCUs 21 in the system #1 is made to be in a thermo-off state or the case where the FCU performance of the FCU 21 varies. The case where the FCU 21 is made to be in the thermo-off state is the case where the fan 122 of the FCU 21 is stopped. To be more specific, for example, when an indoor temperature exceeds the set temperature during heating operation, or when an indoor temperature falls below the set temperature during cooling operation, the FCU 21 is made to be in the thermo-off state. When the FCU 21 is made to be in the thermo-off state or when the FCU performance varies, the controller 4 controls the opening degree of the heat-medium flow adjusting valve 22 in accordance with the thermo-off state or the variation of FCU performance.

FIG. 13 is a schematic view indicating the opening degrees of the heat-medium flow adjusting valves 22 in the case where the FCU 21*b* is made to be in the thermo-off state. FIG. 14 is a schematic view indicating the opening degrees of the heat-medium flow adjusting valves 22 in the case where the FCU performance of the FCU 21*c*, which is the representative FCU, varies.

When the FCU 21*b* is made to be in the thermo-off state, it is unnecessary to cause water to flow into the FCU 21*b*. Therefore, as indicated in FIG. 13, the valve opening-degree determination unit 42 determines the FCU opening degree of the heat-medium flow adjusting valve 22 associated with the FCU 21*b* as 0%, and determines that the bypass opening degree of the heat-medium flow adjusting valve 22 as 100%. In this case, the FCU performance of the FCU 21*c*, which is the representative FCU, does not vary, and only the opening degree of the heat-medium flow adjusting valve 22 associated with the FCU 21*b*, which is made to be in the thermo-off state, is changed.

By contrast, when the FCU performance of the FCU 21*c*, which is the representative FCU, varies, the performance ratio of the FCU performance of the FCU 21*a* to that of the FCU 21*c* and the performance ratio of the FCU performance of the FCU 21*b* to that of the FCU 21*c* vary. In the example indicated in FIG. 14, the FCU performance of the FCU 21*c*, which is the representative FCU, varies from 5 to 3 kW, and as a result at that time, the FCU performance of the FCU 21*a* and the FCU performance of the FCU 21*b* are ⅓ of the FCU performance of the FCU 21*c*.

Therefore, the valve opening-degree determination unit 42 determines the FCU opening degrees of the heat-medium flow adjusting valves 22 associated with the FCU 21*a* and the FCU 21*b* as 33% (100%×⅓), and determines the bypass opening degrees of the heat-medium flow adjusting valves 22 as 67%. As described above, when the FCU performance of the FCU 21*c*, which is the representative FCU, varies, the opening degrees of the heat-medium flow adjusting valves 22 associated with the FCU 21*a* and the FCU 21*b*, which are FCUs other than the representative FCU, are changed.

In this example, the FCU performance that the FCU is currently required to achieved is used as the FCU performance for controlling the opening degree of the heat-medium flow adjusting valve 22. This, however, is not limiting. For example, a set FCU performance determined in advance for each FCU 21 may be used without any change. In this case, it is not necessary to calculate FCU performance that the FCUs 21 are required to currently achieve, and it is therefore possible to simplify the configuration related to the control of the opening degrees of the heat-medium flow adjusting valves 22.

As described above, in Embodiment 1, the representative FCU in the system is determined, and in accordance with the performance ratio between the FCU performance of the representative FCU and the FCU performance of each of the FCUs 21 other than the representative FCU, the opening degree of the heat-medium flow adjusting valve 22 associated with each FCU is determined. Thus, water flows into each FCU 21 at a required rate, and heat of water can be efficiently used.

In this example, the representative FCU of each system is determined based on FCU performance of the FCUs 21. This, however, is not limiting. For example, the representative FCU of each system may be determined in advance. In the case where the representative FCU is determined in advance, as described above, the bypass pipe 23 of the indoor unit 2 that is associated with the representative FCU can be omitted. Furthermore, in an indoor unit 2 from which the bypass pipe 23 is omitted, the heat-medium flow adjusting valve 22 does not need to have a plurality of outflow ports, and has only to have a function of adjusting the flow rate of water that flows into the heat-medium flow adjusting valve 22 and then causing the water to flow out therefrom.

As described above, in the air-conditioning apparatus 100 according to Embodiment 1, the indoor units 2 are connected in series. A heat medium subjected to heat exchange with indoor air is caused to flow into the heat exchangers connected in series. Thus, heat of the heat medium is used by the plurality of indoor units 2. That is, the heat of the heat medium can be efficiently used. In the case where the heat medium is water, a phase change in the heat medium circuit is small, and a change in temperature of the heat medium is smaller than that of refrigerant. Thus, the plurality of indoor units 2 can be connected in series. Furthermore, since the plurality of indoor units 2 are connected in series, the pipe length is smaller than that in the case where the indoor units 2 are connected in parallel, it is possible to reduce a loss caused by, for example, heat radiation that occurs when water flows through the pipe.

Each of the indoor units 2*a* to 2*c* includes the heat-medium flow adjusting valve 22 that can control the flow rate, and the use-side heat exchanger 121 connected with the first outflow port 22*b* of the heat-medium flow adjusting valve 22, Furthermore, in the air-conditioning apparatus 100, the indoor units 2 are connected in series. Thus, since a necessary amount of water flows into the FCU 21, and heat of water can be efficiently used.

Each of the indoor units 2*a* to 2*c* further includes the bypass pipe 23 that is formed such that the second outflow port 22*c* of the heat medium flow control valve 22 is connected with the water outflow side of the use-side heat exchanger 121. With such a configuration, each FCU 21 can easily achieve desired FCU performance.

Furthermore, the bypass pipe 23 is formed to pass through a region located outside the indoor unit 2. Thus, the length of the bypass pipe 23 is shortened, and it is therefore possible to reduce a loss caused by, for example, heat radiation that occurs when water flows through the pipe.

Furthermore, the air-conditioning apparatus 100 includes the controller 4 that controls the opening degrees of the heat-medium flow adjusting valves 22 based on the performance of the respective FCUs 21 of the indoor units 2*a* to 2*c*, The controller 4 includes the valve opening-degree determination unit 42 that controls the opening degrees of the heat-medium flow adjusting valves 22 based on the performance ratios between the FCU performance of the representative FCU having the highest CPU performance among the FCU performances of the FCUs 21 of the indoor units 2 and the FCU performance of the other FCUs 21. Thus, it is possible to supply a necessary amount of water to each of the FCUs 21.

Furthermore, the controller 4 also includes the FCU performance calculation unit 41 that calculates the FCU performance of each of the plurality of the FCUs 21 based on a temperature at the inlet of each FCU 21, a temperature at the outlet thereof, and the temperature of air sucked into the FCU 21. It is therefore possible to calculate the FCU performance that each of the FCUs 21 is currently required to achieve.

Embodiment 2

Next, an air-conditioning apparatus according to Embodiment 2 of the present disclosure will be described. In Embodiment 2, the system #1 including the indoor units 2*a* to 2*c* connected in series and a system #2 including a plurality of indoor units 2*d* to 2*f* connected in series are connected parallel to each other. In this regard, Embodiment 2 is different from Embodiment 1. Regarding Embodiment 2, components that are the same as those in Embodiment 1 will be denoted by the same reference signs, and their detailed descriptions will thus be omitted.

[Configuration of Air-Conditioning Apparatus 200]

Figure 15:
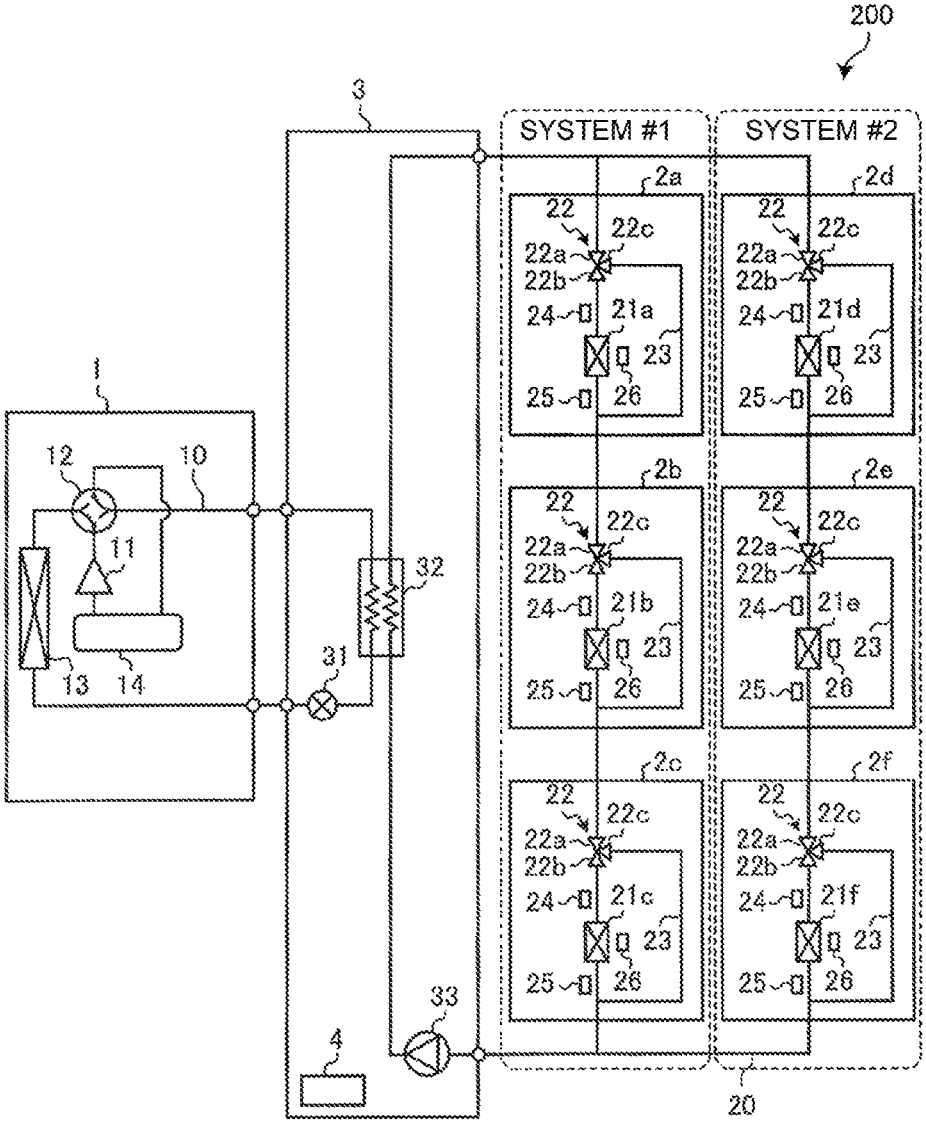
FIG. 15 is a schematic view illustrating an example of the configuration of an air-conditioning apparatus according to Embodiment 2.

FIG. 15 is a schematic view illustrating an example of the configuration of an air-conditioning apparatus 200 according to Embodiment 2. As illustrated in FIG. 15, the air-conditioning apparatus 200 includes the outdoor unit 1, the plurality of indoor units 2*a* to 2*f*, and the relay unit 3. The outdoor unit 1 and the relay unit 3 are connected by the refrigerant pipe 10, whereby a refrigerant circuit is formed. The indoor units 2*a* to 2*f* and the relay unit 3 are connected by the heat medium pipe 20, whereby a heat medium circuit is formed. The indoor units 2*a* to 2*c* are connected in series, thus forming the system #1. The indoor units 2*d* to 2*f* are connected in series, thus forming the system #2. The indoor units 2*a* to 2*c* of the system #1 and the indoor units 2*d* to 2*f* of the system #2 are connected in parallel.

[Operation of Air-Conditioning Apparatus 200]

Next, the operation of the air-conditioning apparatus 200 having the above configuration will be described. The following description is made with respect to the flow of water serving as a heat medium that circulates in the heat medium circuit. The flow-rate control process in the indoor unit 2*a* to 2*f* is the same as that in Embodiment 1, and its description will thus be omitted.

(Flow of Heat Medium)

FIG. 15 illustrates an example of a circuit configuration in the case where in the air-conditioning apparatus 200, the system #1 including the indoor units 2*a* to 2*c* connected in series and the system #2 including the indoor units 2*d* to 2*f* connected in series are connected parallel to the relay unit 3.

In the relay unit 3, water that has flowed out from the intermediate heat exchanger 32 flows out of the relay unit 3 through the heat medium pipe 20. The water that has flowed out of the relay unit 3 branches off and flows into two systems #1 and #2. The water flows into the indoor unit 2*a*, which is the indoor unit located at the most upstream side in the system #1, and also into the indoor unit 2*d*, which is the indoor unit located on the most upstream side in the system #2. The flow of water in the system #1 is the same as that of Embodiment 1, and its description will thus be omitted.

In the indoor unit 2*d* of the system #2, the water that has flowed into the indoor unit 2*d* flows through the FCU 21*d* or an bypass pipe 23 of the indoor unit 2*d* at a flow rate that depends on the set opening degree of the heat-medium flow adjusting valve 22. The water that has flowed into the FCU 21*d* exchanges heat with indoor air to receive or transfer heat, thereby cooling or heating the indoor air, and the water then flows out of the FCU 21*d*. The water that has flowed out of the FCU 21*d* and the water that flows through the bypass pipe 23 joins each other at a location downstream of the FCU 21*d*, and flows into the indoor unit 2*e*, which is an indoor unit located downstream of the indoor unit 2*d*.

In the indoor unit 23*e*, the water that has flowed into the indoor unit 2*e* flows through an FCU 21*e* or an bypass pipe 23 of the indoor unit 2*e* at a flow rate that depends on the set opening degree of the heat-medium flow adjusting valve 22. The water that has flowed into the FCU 21*e* exchanges heat with indoor air to receiver or transfer heat from or to the indoor air, thereby cooling or heating the indoor air, and the water then flows out of the FCU 21*e*. The water that has flowed out of the FCU 21*e* and the water that flows through the bypass pipe 23 join each other at a location downstream of the FCU 21*e*, and flows into the indoor unit 2*f*, which is an indoor unit located downstream of the indoor unit 2*e*.

In the indoor unit 2*f*, the water that has flowed into the indoor unit 2*f* flows through an FCU 21*f* or an bypass pipe 23 of the indoor unit 2*f* at a flow rate that depends on the set opening degree of the heat-medium flow adjusting valve 22. The water that has flowed into the FCU 21*f* exchanges heat with indoor air to receive or transfer heat from or to the indoor air, thereby cooling or heating the indoor air, and the water flows out of the FCU 21*f*. The water that has flowed out of the FCU 21*f* and the water that flows through the bypass pipe 23 join each other at a location downstream of the FCU 21*f*, and flows out of the indoor unit 2*f*.

The water that has flowed out of the indoor unit 2*c*, which is the indoor unit located on the most downstream side in the system #1, and the water that has flowed out of the indoor unit 2*f*, which is the indoor unit located on the most downstream side in the system #2, join each other, and flow into the relay unit 3 through the heat medium pipe 20. The water that has flowed into the relay unit 3 flows into the intermediate heat exchanger 32 via the pump 33. Thereafter, the above circulation is repeated.

As described above, the air-conditioning apparatus 200 according to Embodiment 2 includes the plurality of systems each of which includes the plurality of indoor units 2 connected in series, and the plurality of systems are connected in parallel. Even in the case where the plurality of systems, each of which includes the plurality of indoor units 2 connected in series, are provided in the above manner, a necessary amount of water flows into each of the FCUs 21, and heat of water can be efficiently used, as in Embodiment 1.

Embodiment 3

Next, an air-conditioning apparatus according to Embodiment 3 of the present disclosure will be described. In Embodiment 3, the system #1 including the indoor units 2*a* to 2*c* connected in series, the system #2 including the plurality of indoor units 2*d* to 2*f* connected in series, and a system #3 including a plurality of indoor units 2*g* to 2*i* connected in series are connected in parallel. In this regard, Embodiment 3 is different from Embodiments 1 and 2. Regarding Embodiment 3, components that are the same as those in any of Embodiments 1 and 2 will be denoted by the same reference signs, and their detailed descriptions will thus be omitted.

[Configuration of Air-Conditioning Apparatus 300]

Figure 16:
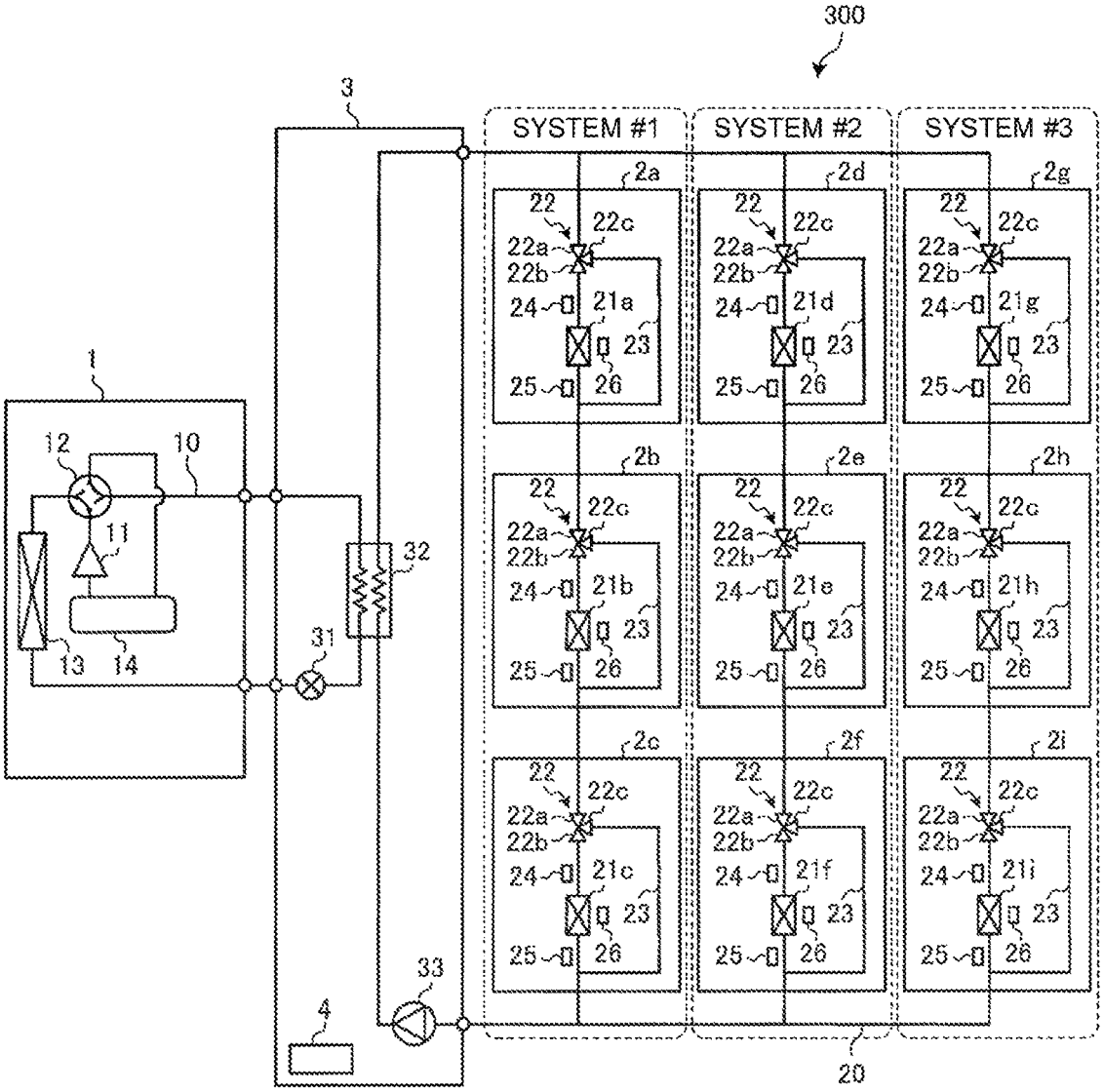
FIG. 16 is a schematic view illustrating an example of the configuration of an air-conditioning apparatus according to Embodiment 3.

FIG. 16 is a schematic view illustrating an example of the configuration of an air-conditioning apparatus 300 according to Embodiment 3. As illustrated in FIG. 16, the air-conditioning apparatus 300 includes the outdoor unit 1, the plurality of indoor units 2*a* to 2*i*, and the relay unit 3. The outdoor unit 1 and the relay unit 3 are connected by the refrigerant pipe 10, whereby a refrigerant circuit is formed. The plurality of indoor units 2*a* to 2*i* and the relay unit 3 are connected by the heat medium pipe 20, whereby a heat medium circuit is formed. Furthermore, the indoor units 2*a* to 2*c* are connected in series, thus forming the system #1. The indoor units 2*d* to 2*f* are connected in series, thus forming the system #2. The indoor units 2*g* to 2*i* are connected in series, thus forming the system #3. The indoor units 2*a* to 2*c* of the system #1, the indoor units 2*d* to 2*f* of the system #2, and the indoor units 2*g* to 2*i* of the system #3 are connected in parallel.

[Operation of Air-Conditioning Apparatus 300]

Next, the operation of the air-conditioning apparatus 300 having the above configuration will be described. The following description is made with respect to the flow of water serving as a heat medium that circulates through the heat medium circuit and the control of the flow rate of water for each of the systems #1 to #3.

(Flow of Heat Medium)

FIG. 16 illustrates an example of a circuit configuration in which in the air-conditioning apparatus 300, the system #1 including the indoor units 2*a* to 2*c* connected in series, the system #2 including the indoor units 2*d* to 2*f* connected in series, the system #3 including the indoor units 2*g* to 2*i* connected in series are connected parallel to the relay unit 3.

In the relay unit 3, water that has flowed out of the intermediate heat exchanger 32 flows out of the relay unit 3 through the heat medium pipe 20. The water that has flowed out of the relay unit 3 branches off and flows into three systems #1 to #3. The water flows into the indoor unit 2*a*, which is the indoor unit located on the most upstream side in the system #1, into the indoor unit 2*d*, which is the indoor unit located on the most upstream side in the system #2, and into the indoor unit 2*g*, which is the indoor unit located on the most upstream side in the system #3, The flow of water in the systems #1 and #2 is the same as that in Embodiment 2, and its description will thus be omitted.

In the indoor unit 2*g* of the system #3, the water that has flowed into the indoor unit 2*g* flows through an FCU 21*g* or an bypass pipe 23 of the indoor unit 2*g* at a flow rate that depends on the set opening degree of the heat-medium flow adjusting valve 22. The water that has flowed into the FCU 21*g* exchanges heat with indoor air to receive or transfer heat from or to the indoor air, thereby cooling or heating the indoor air, and the water flows out of the FCU 21*g*. The water that has flowed out of the FCU 21*g* and the water that flows through the bypass pipe 23 join each other at a location downstream of the FCU 21*g*, and flow into the indoor unit 2*h*, which is the indoor unit located downstream of the indoor unit 2*g*.

In the indoor unit 2, the water that has flowed into the indoor unit 2*h* flows through an FCU 21*h* or an bypass pipe 23 of the indoor unit 2*h* at a flow rate that depends on the set opening degree of the heat-medium flow adjusting valve 22. The water that has flowed into the FCU 21*h* exchanges heat with indoor air to receive or transfer heat from or to the indoor air, thereby cooling or heating the indoor air, and the water flows out of the FCU 21*h*. The water that has flowed out of the FCU 21*h* and the water that flows through the bypass pipe 23 join each other at a location downstream of the FCU 21*h*, and flow into the indoor unit 2*i*, which is the indoor unit located downstream of the indoor unit 2*h*.

In the indoor unit 2*i*, the water that has flowed into the indoor unit 2*i* flows through an FCU 21*i* or an bypass pipe 23 of the FCU 21*i* at a flow rate that depends on the set opening degree of the heat-medium flow adjusting valve 22. The water that has flowed into the FCU 21*i* exchanges heat with indoor air to receive or transfer heat from or to the indoor air, thereby cooling or heating the indoor air, and the water flows out of the FCU 21*i*. The water that has flowed out of the FCU 21*i* and the water that flows through the bypass pipe 23 join each other at a location downstream of the FCU 21*i*, and flow out of the indoor unit 2*i*.

The water that has flowed out of the indoor unit 2*c*, which is the indoor unit located on the most downstream side in the system #1, the water that has flowed out of the indoor unit 2*f*, which is the indoor unit located on the most downstream side in the system #2, and the water that has flowed out of the indoor unit 2*i*, which is the indoor unit located on the most downstream side in the system #3, join together, and flow into the relay unit 3 through the heat medium pipe 20. The water that has flowed into the relay unit 3 flows into the intermediate heat exchanger 32 via the pump 33. Thereafter, the above circulation is repeated.

(Control of Flow Rates of Water for Systems #1 to #3)

Next, the control of the flow rates of water for the systems #1 to #3 will be described. The following is made with respect to the control of the flow rates of water in the case where the representative FCUs in the systems #1 to #3 have different FCU performance. FIGS. 17 to 20 are schematic views indicating the opening degrees of the heat-medium flow adjusting valves 22 in the case where the representative FCUs in the respective systems #1 to #3 have different FCU performance. In FIGS. 17 to 20, the FCUs 21 indicated by bold lines are the representative FCUs in the systems #1 to #3.

FIG. 17 is a schematic view indicating a first example of the opening degrees of the heat-medium flow adjusting valves in the case where the representative FCUs in the systems #1 to #3 have different FCU performance. The first example indicated in FIG. 17 is an example in which the FCU opening degree of the heat-medium flow adjusting valve 22 that depends on the representative FCU in each of all systems #1 to #3 is set to 100% regardless of the FCU performance of the representative FCU.

In the first example, the representative FCUs of the systems #1 to #3 are the FCUs 21*c*, 21*e* and 21*g*, respectively. Therefore, the heat-medium flow adjusting valves 22 associated with the FCUs 21*c*, 21*e* and 21*g* are set as illustrated in FIG. 5. In this case, water flows equally in the systems #1 to #3, and the FCU opening degree of the heat-medium flow adjusting valve 22 that depends on the representative FCU of each of the systems #1 to #3 is 100%. It is therefore possible to simplify the control of the heat-medium flow adjusting valves 22 associated with the representative FCUs.

In this example, the representative FCU of the system #2 has the highest FCU performance, and in the systems #1 and #3, water flows at a flow rate equivalent to that in the system #2. Therefore, the performance of each of the systems #1 and #3 is excessively high, and thus an indoor space may be excessively cooled or heated. Thus, in this case, it is appropriate that the FCU in each of the systems #1 and #3 is made to be in the thermos-off state, to thereby prevent excessive cooling or excessive heating.

To be more specific, the valve opening-degree determination unit 42 sets the bypass opening degree of the heat-medium flow adjusting valve 22 associated with the FCU 21*a* in the system #1 to 100%, and causes the FCU 21*a* to be in the thermo-off state. Furthermore, the valve opening-degree determination unit 42 sets the bypass opening degree of the heat-medium flow adjusting valve 22 associated with the FCU 21*i* in the system #3 to 100%, and causes the FCU 21*i* to be in the thermo-off state.

FIG. 18 is a schematic view illustrating a second example of the opening degrees of the heat-medium flow adjusting valves in the case where the representative FCUs of systems #1 to #3 have difference FCU performance. The second example indicated in FIG. 18 is an example in which in order to reduce excessively high performance in the first example, expansion devices for controlling the flow rate are provided at respective positions immediately after the heat medium pipes in the respective systems #1 to #3 branch off, that is, on the most upstream sides of the respective systems #1 to #3. Thus, a necessary amount of water for each of the systems #1 to #3 is supplied to each system.

In the second example, the FCU performance of the FCU 21*e*, which is the representative FCU of the system #2, is 7 kW, and the FCU 21*e* has the highest FCU performance. Thus, the controller 4 sets the opening degree of the expansion device of the system #2 such that the expansion device of the system #2 is made to be in a fully opened state, and determines the opening degrees of the expansion devices of the systems #1 and #3 based on the FCU performance of the representative FCU of the system #2. In this case, the FCU performance of the FCU 21*c*, which is the representative FCU of the system #1, is 5 kW, and the opening degree of the expansion device of the system #1 is thus determined as 71% kW/7 kW×100%). The FCU performance of the FCU 21*g*, which is the representative FCU of the system #3, is 4 kW and the opening degree of the expansion device of the system #3 is thus determined as 57% (≈4 kW/7 kW×100%).

In the case where a FCU 21 to be caused to be in the thermo-off state is present in a system, the heat-medium flow adjusting valve 22 associated with the FCU 21 may be set as illustrated in FIG. 8. That is, the FCU opening degree of the heat-medium flow adjusting valve 22 is set to 0%, and the bypass opening degree is set to the set opening degree. When the opening degree of the heat-medium flow adjusting valve 22 is set as illustrated in FIG. 8, the heat-medium flow adjusting valve 22 serves as an expansion device, whereby the flow rate of water that flows into the FCUs 21 following the above associated FCU 21 is controlled. Therefore, the flow rate of water that flows through each of the systems #1 to #3 can be controlled without providing the expansion devices described above.

FIG. 19 is a schematic view illustrating a third example of the opening degrees of the heat-medium flow adjusting valves in the case where the representative FCUs in the respective systems #1 to #3 have difference FCU performance. The third example indicated in FIG. 19 is an example in which the heat-medium flow adjusting valves 22 associated with the representative FCUs in the systems #1 to #3 are made to have different FCU opening degrees in accordance with the FCU performance of the representative FCUs.

In the third example, the FCU opening degree of the heat-medium flow adjusting valve 22 associated with the representative FCU having the highest FCU performance among the FCU performances of the representative FCUs in the respective systems #1 to #3 is determined as 100%. The FCU opening degrees of the heat-medium flow adjusting valves 22 associated with the representative FCUs other than the above representative FCU are determined based on respective performance ratios.

More specifically, the FCU performance of the FCU 21*e*, which is the representative FCU of the system #2, is 7 kW and the highest in the FCUs. Thus, the controller 4 sets the FCU opening degree of the heat-medium flow adjusting valve 22 associated with the representative FCU of the system #2 to 100%. Then, the controller 4 determines the FCU opening degrees of the heat-medium flow adjusting valves 22 associated with the representative FCUs of the systems #1 and #3 based on the respective ratios of the FCU performance of the representative FCUs to the above set FCU opening degree of the heat-medium flow adjusting valve 22.

In this case, the FCU performance of the FCU 21*c*, which is the representative FCU of the system #1, is 5 kW. Therefore, based on the performance ratio between the FCU performance of the FCU 21*c* and the FCU performance of the representative FCU in the system #2, it is determined that the FCU opening degree of the heat-medium flow adjusting valve 22 associated with the representative FCU of the system #1 is 71% kW/7 kW×100%). The FCU performance of the FCU 21*g*, which is the representative FCU of the system #3, is 4 kW. Therefore, based on the performance ratio between the FCU performance of the FCU 21*g* and the FCU performance of the representative FCU in the system #2, it is determined that the FCU opening degree of the heat-medium flow adjusting valve 22 associated with the representative FCU of the system #3 is 57% (≈4 kW/7 kW×100%).

As described above, by setting the opening degrees of the heat-medium flow adjusting valves 22 to different values based on the respective FCU performance of the representative FCUs of the respective systems #1 to #3, it is possible to perform a fine control such that air conditioning performance is controlled for respective air-conditioned spaces where the indoor units 2 of the systems #1 to #3 are provided. Furthermore, it is possible to reduce the flow rate of water into the FCU 21 at a flow rate higher than a required flow rate, and heat can be more efficiently used.

In the third example, the FCUs 21 can achieve required FCU performance, and the flow rates at which water flows through the respective systems #1 to #3 are equivalent to each other. Thus, water flows into each of the systems #1 and #3 at an excessively high flow rate, FIG. 20 is a schematic view illustrating a fourth example of the opening degrees of the heat-medium flow adjusting valves in the case where the representative FCUs in the respective systems #1 to #3 have difference FCU performance. The fourth example indicated in FIG. 20 is an example where the opening degrees of the heat-medium flow adjusting valves 22 associated with the representative FCUs of the systems other than the system including the representative FCU having the highest performance are adjusted in order to reduce the flow rate of water that flows at an excessively high flow rate in the third example.

In the fourth example, as in the third example, the valve opening-degree determination unit 42 sets the FCU opening degree of the heat-medium flow adjusting valve 22 associated with the FCU 21*e*, which is the representative FCU of the system #2, to 100%, Furthermore, the valve opening-degree determination unit 42 sets the opening degrees of the heat-medium flow adjusting valves 22 associated with the FCU 21*c* and the FCU 21*g*, which are the representative FCUs of the systems #1 and #3 that are systems other than the system #2, as illustrated in FIG. 10. The opening degrees of the heat-medium flow adjusting valves 22 are set as illustrated in FIG. 10, whereby the flow rate of water that flows into the FCUs 21 following the above associated FCU 21 is adjusted.

That is, the FCU opening degrees of the heat-medium flow adjusting valves 22 associated with the representative FCUs of the systems #1 and #3 are set based on the ratio of the FCU performance of the representative FCU to the FCU opening degree of the heat-medium flow adjusting valve 22 associated with the representative FCU of the system #2. Furthermore, at this time, the bypass opening degrees of the heat-medium flow adjusting valves 22 are set to 0%.

More specifically, the heat-medium flow adjusting valve 22 associated with the FCU 21*c*, which is the representative FCU of the system #1, is set such that the FCU opening degree is 71% and the bypass opening degree is 0%. Furthermore, the heat-medium flow adjusting valve 22 associated with the FCU 21*g*, which is the representative FCU of the system #3, is set such that the FCU opening degree is 57% and the bypass opening degree is 0%.

As described above, the opening degrees of the heat-medium flow adjusting valves 22 are set such that the bypass opening degrees of the heat-medium flow adjusting valves 22 associated with the representative FCUs of the systems other than the system including the representative FCU having the highest performance are 0%, whereby the flow rates of water for the respective systems #1 to #3 can be adjusted.

As described above, in the air-conditioning apparatus 300 according to Embodiment 3, the valve opening-degree determination unit 42 sets the opening degrees of the heat-medium flow adjusting valves 22 associated with the representative FCUs of the respective systems such that the heat-medium flow adjusting valves 22 are made to be in the fully opened state. Furthermore, the valve opening-degree determination unit 42 determines the opening degrees of the heat-medium flow adjusting valves 22 associated with other FCUs based on the respective performance ratios. Therefore, it is possible to simplify the control of the opening degrees of the heat-medium flow adjusting valves 22 in the respective systems.

Moreover, the expansion devices are provided on the most upstream sides of the respective systems, and the controller 4 determines the opening degrees of the expansion devices of the respective systems based on the performance ratios of the representative FCUs of the respective systems. Therefore, it is possible to supply a required amount of water to each of the systems.

The valve opening-degree determination unit 42 sets the opening degree of the heat-medium flow adjusting valve 22 connected to the representative FCU having the highest FCU performance among the representative FCUs of all the systems such that the heat-medium flow adjusting valve 22 is made to be in the fully opened state. Furthermore, the valve opening-degree determination unit 42 determines the opening degree of the heat-medium flow adjusting valve 22 connected to another representative FCU based on the performance ratio of the FCU performance of the above other representative FCU to the FCU performance of the representative FCU having the highest performance. Then, the valve opening-degree determination unit 42 determines the opening degree of the heat-medium flow adjusting valve 22 associated with the above other representative FCU such that the heat-medium flow adjusting valve 22 allows the heat-medium outflow side of the other representative FCU to communicate with the second outflow port 22*c*. As a result, the flow rate of water for each system is appropriately set, and unnecessary transfer power can be reduced.

Embodiment 4

Next, an air-conditioning apparatus according to Embodiment 4 of the present disclosure will be described. In Embodiment 4, the indoor units 2*a* to 2*i* are provided with respective indoor-side controllers. In this regard, Embodiment 4 is different from Embodiments 1 to 3. Regarding Embodiment 4, components that are the same as those of any of Embodiments 1 to 3 will be denoted by the same reference signs, and their detailed descriptions will thus be omitted,

[Configuration of Air-Conditioning Apparatus 400]

Figure 21:
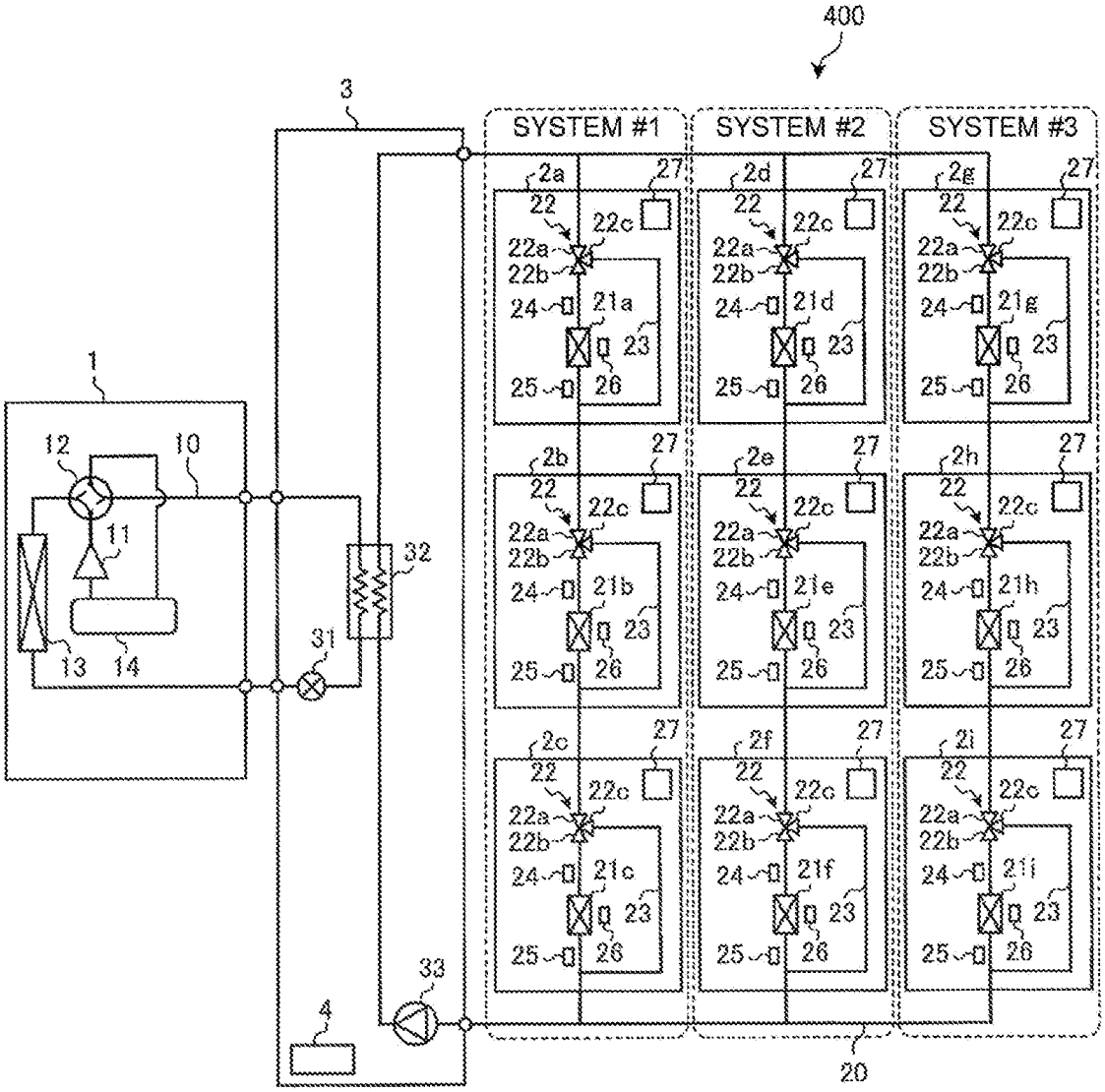
FIG. 21 is a schematic view illustrating an example of the configuration of an air-conditioning apparatus according to Embodiment 4.

FIG. 21 is a schematic view illustrating an example of the configuration of an air-conditioning apparatus 400 according to Embodiment 4. As illustrated in FIG. 21, the air-conditioning apparatus 400 includes the outdoor unit 1, the plurality of indoor units 2*a* to 2*i*, and the relay unit 3. The outdoor unit 1 and the relay unit 3 are connected to by the refrigerant pipe 10, whereby a refrigerant circuit is formed. The plurality of indoor units 2*a* to 2*i* and the relay unit 3 are connected by the heat medium pipe 20, whereby a heat medium circuit is formed. The indoor units 2*a* to 2*c* are connected in series, thus forming the system #1. The indoor units 2*d* to 2*f* are connected in series, thus forming the system #2. The indoor units 2*g* to 2*i* are connected in series, thus forming the system #3. The indoor units 2*a* to 2*c* of the system #1, the indoor units 2*d* to 2*f* of the system #2, and the indoor units 2*g* to 2*i* of the system #3 are connected in parallel, respectively.

In Embodiment 4, as illustrated in FIG. 21, each of the indoor units 2*a* to 2*i* includes an indoor-side controller 27 in addition to the configuration as illustrated in FIG. 2. The indoor-side controller 27 controls components in an indoor unit 2 in which the indoor-side controller 27 is provided. Of various controls by the controller 4 of each of Embodiment 1 to 3, a control related to the indoor unit 2 in which the indoor-side controller 27 is provided is performed by the indoor-side controller 27. To be more specific, the indoor-side controller 27 controls calculation of the FCU performance of the FCU 21, the opening degree of the heat-medium flow adjusting valve 22 based on the calculated FCU performance, etc.

The indoor-side controller 27 communicates with indoor-side controllers 27 provided in the other indoor units 2 and with the controller 4 provided in the relay unit 3. For example, the indoor-side controllers 27 exchanges information with each other, which is, for example, information from sensors including the inlet temperature sensor 24, the outlet temperature sensor 25, the suction temperature sensor 26 and other sensors, and information related to the control of the opening degree of the heat-medium flow adjusting valve 22.

As described above, the indoor units 2*a* to 2*i* are provided with the respective indoor-side controllers 27, whereby it is possible to perform an interlocking control between the outdoor unit 1, the indoor units 2 and the relay unit 3. Furthermore, it is possible to easily replace each indoor unit 2 solely with a new one.

Embodiment 5

Next, an air-conditioning apparatus according to Embodiment 5 of the present disclosure will be described. In Embodiment 5, the opening degree of the heat-medium flow adjusting valves 22 are controlled to reduce the degree of deficiency in the starting performance of the indoor units 2*a* to 2*i* at the time when the indoor units 2*a* to 2*i* start their operation from the stopped state. Regarding Embodiment 6, components that are the same as Embodiment 1 will be denoted by the same reference signs, and their detailed descriptions will thus be omitted.

In Embodiment 5, the valve opening-degree determination unit 42 set the opening degrees of the heat-medium flow adjusting valves 22 in the indoor units 2*a* to 2*i* such that when all the indoor units 2*a* to 2*i* are in the stopped state, the heat-medium flow adjusting valves 22 allow water that circulates in the heat medium circuit to flow through the bypass pipes 23. To be more specific, the valve opening-degree determination unit 42 sets the opening degrees of all the heat-medium flow adjusting valves 22 such that the bypass opening degrees are 100%, thereby causing the second outflow ports 22*c* to communicate with the water outflow sides of the FCUs 21.

In such a manner, by controlling the opening degrees of the heat-medium flow adjusting valves 22 such that water that circulates in the heat medium circuit flows through the bypass pipes 23, heat is accumulated in water that is a heat medium. Thus, it is possible to perform precooling or preheating such that the temperature of water that circulates in the heat medium circuit reaches a temperature suitable for air conditioning, and it is therefore possible to reduce the degree of deficiency in the starting performance of the indoor units 2*a* to 2*i* at the time when the indoor units 2*a* to 2*i* start their operations from the stopped state.

As described above, in the air-conditioning apparatus 100 according to Embodiment 5, the valve opening-degree determination unit 42 sets the opening degrees of all the heat-medium flow adjusting valves 22 such that when the indoor units 2*a* to 2*i* are in the stopped state, the heat-medium flow adjusting valves 22 allow the second outflow ports 22*c* and the water outflow sides of the FCUs 21 to communicate with each other. Thus, heat is accumulated in water serving as the heat medium, and it is therefore possible to reduce the degree of deficiency in the starting performance of the indoor units 2*a* to 2*i* at the time when the indoor units 2*a* to 2*i* start their operation from the stopped state.

Although the above descriptions are made with respect to Embodiments 1 to 5 of the present disclosure, they are not limiting, and various modifications and applications can be made without departing from the scope of the present disclosure. For example, it is explained above that the outdoor unit 1 and the relay unit 3 are formed as separate units, but such an explanation is not limiting. The outdoor unit 1 and the relay unit 3 may be formed as a single body.

Furthermore, it is explained above that the opening degree of the heat-medium flow adjusting valve 22 is determined based on FCU performance, which can be found from various temperature information. However, this is also true of other examples. For example, the opening degree of the heat-medium flow adjusting valve 22 may be determined based on information on whether each of the indoor units 2 is in the thermos-on state or the thermos-off state.

Moreover, a radiant panel may be used as a load-side unit. At the radiant panel, when a heat medium flows through a pipe of the radiant panel, heat exchange is performed. Therefore, in the thermo-off state, the heat medium is caused to flow through a bypass pipe to inhibit the heat medium from flowing through the pipe of the radiant panel.

Furthermore, although it is described above that the pump 33 is provided in the relay unit 3, the description is not limiting. The pump 33 may be formed separate from the relay unit 3 as a pump unit, for example.

REFERENCE SIGNS LIST

1 outdoor unit 2, 2*a*, 2*b*, 2*c*, 2*d*, 2*e*, 2*f*, 2*g*, 2*h*, 2*i* indoor unit 3 relay unit 4 controller 10 refrigerant pipe 11 compressor 12 refrigerant-flow switching device 13 heat-source-side heat exchanger 14 accumulator 20 heat medium pipe 21, 21*a*, 21*b*, 21*c*, 21*d*, 21*e*, 21*f* fan coil unit 22 heat-medium flow adjusting valve 22*a* inflow port 22*b* first outflow port 22*c* second outflow port 22*d* body 22*e* opening-degree adjusting valve 22*f* side wall 22*g* partition wall 22*h* opening port 23 bypass pipe 24 inlet temperature sensor 25 outlet temperature sensor 26 suction temperature sensor 27 indoor-side controller 31 expansion valve

32 intermediate heat exchanger 33 pump 41 FCU performance calculation unit 42 valve opening-degree determination unit 43 valve control unit 44 heat-medium flow-rate determination unit 45 pump control unit

46 storage unit 100, 200, 300, 400 air-conditioning apparatus 121 use-side heat exchanger 122 fan

The invention claimed is:

1. An air-conditioning apparatus comprising:

a controller; and a plurality of indoor units each including:

a heat-medium flow adjusting valve having an inflow port through which the heat medium flows into the heat-medium flow adjusting valve, and a plurality of outflow ports configured to control a flow rate of the heat medium, and allow the heat medium to flow out of the heat-medium flow adjusting valve; and a heat exchanger configured to cause heat exchange to be performed between the heat medium and air, the heat medium flowing into the heat exchanger from an inflow side of the heat exchanger, the inflow side of the heat exchanger being connected to one of the plurality of outflow ports of the heat-medium flow adjusting valve, wherein the plurality of indoor units are connected in series, the each of the plurality of indoor units further includes a bypass pipe that is provided such that an other of the plurality of outflow ports of the heat-medium flow adjusting valve is connected to an outflow side of the heat exchanger from which the heat medium flows out of the heat exchanger, and the bypass pipe is provided to extend through a region located outside the each of the plurality of indoor units, wherein the controller is configured to control, for each of the indoor units, an opening degree of the heat-medium flow adjusting valve to correspond to an operating performance for the heat exchanger of the each indoor unit, wherein the operating performance is determined for the each indoor unit as a performance ratio of a performance of the heat exchanger of the each indoor unit to a performance of a representative heat exchanger, performance being determined for each of the heat exchangers other than the representative heat exchanger.

2. The air-conditioning apparatus of claim 1, wherein the controller is configured to determine, as the representative heat exchanger, a heat exchanger having highest performance among the heat exchangers of the plurality of indoor units.

3. The air-conditioning apparatus of claim 1, wherein the each of the plurality of indoor units further includes an inlet temperature sensor configured to detect an inlet temperature of the heat medium that flows into the heat exchanger, an outlet temperature sensor configured to detect an outlet temperature of the heat medium that flows out of the heat exchanger, and a suction temperature sensor configured to detect a suction air temperature of air that is sucked into the heat exchanger, and the controller is configured to calculate performance of each of the plurality of the heat exchangers based on the inlet temperature, the outlet temperature, and the suction air temperature.

* * * * *